US009937510B2

(12) United States Patent
Kang

(10) Patent No.: US 9,937,510 B2
(45) Date of Patent: Apr. 10, 2018

(54) FOUNDATION CONTAINER PROVIDED WITH DISCHARGE PUMP HAVING SHORT STROKE DISTANCE AND CONTENT SPREADING MEMBER

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 48 days.

(21) Appl. No.: 14/905,280

(22) PCT Filed: Jul. 11, 2014

(86) PCT No.: PCT/KR2014/006243

§ 371 (c)(1),
(2) Date: Jan. 14, 2016

(87) PCT Pub. No.: WO2015/008977

PCT Pub. Date: Jan. 22, 2015

(65) Prior Publication Data

US 2016/0136666 A1 May 19, 2016

(30) Foreign Application Priority Data

Jul. 15, 2013 (KR) ..... 20-2013-0005858 U

(51) Int. Cl.
*B05B 11/00* (2006.01)
*A45D 34/00* (2006.01)
(Continued)

(52) U.S. Cl.
CPC ..... *B05B 11/3028* (2013.01); *A45D 33/006* (2013.01); *A45D 33/02* (2013.01);
(Continued)

(58) Field of Classification Search
CPC ..... A45D 33/02; A45D 34/00; A45D 34/04; B05B 11/3028; B05B 11/3052
See application file for complete search history.

(56) References Cited

U.S. PATENT DOCUMENTS 9,718,073 B2 * 8/2017 Kang ..... B05B 11/3025
2010/0101600 A1 * 4/2010 Kang ..... A45D 33/02 132/299

(Continued)

FOREIGN PATENT DOCUMENTS

JP 05-023135 Y2 6/1993
KR 20-0370307 Y1 12/2004

(Continued)

*Primary Examiner* — J. Casimer Jacyna
(74) *Attorney, Agent, or Firm* — Heedong Chae; Lucem, PC

(57) ABSTRACT

The present invention relates to a foundation container comprising an outer container main body (100) and an outer container lid (150) opened/closed while hinge-coupled to the outer container main body (100), the foundation container being provided with a discharge pump having a short stroke distance and a content spreading member and characterized by comprising: an inner container main body (300) formed inside the outer container main body (100); an inner container lid (400) for covering the upper part of the inner container main body (300); an inner container shielding plate (350) coupled to the upper inside of the inner container main body (300); the discharge pump (600) coupled to the center of the inner container shielding plate (350); the content spreading member (700) coupled to the upper part of the discharge pump (600); and an impregnated member (800) coupled to the upper part of the content spreading member (700).

17 Claims, 17 Drawing Sheets

(51) Int. Cl.

| | |
|---|---|
| ***A45D 33/00*** | (2006.01) |
| ***A45D 33/02*** | (2006.01) |
| ***A45D 34/04*** | (2006.01) |

(52) U.S. Cl.

CPC ..... *A45D 34/00* (2013.01); *A45D 34/04* (2013.01); *B05B 11/3052* (2013.01); *A45D 2200/056* (2013.01); *A45D 2200/1018* (2013.01); *B05B 11/0048* (2013.01); *B05B 11/3025* (2013.01); *B05B 11/3047* (2013.01)

(56) References Cited

U.S. PATENT DOCUMENTS

| | | | | |
|---|---|---|---|---|
| 2012/0305606 | A1* | 12/2012 | Lee | A45D 33/02 222/256 |
| 2016/0227903 | A1* | 8/2016 | Kang | A45D 34/00 |
| 2016/0235183 | A1* | 8/2016 | Lee | B05B 15/002 |
| 2016/0303602 | A1* | 10/2016 | Kang | B05B 11/3001 |
| 2017/0049213 | A1* | 2/2017 | Kang | A45D 34/00 |

FOREIGN PATENT DOCUMENTS

| | | | |
|---|---|---|---|
| KR | 10-0758625 | B1 | 9/2007 |
| KR | 10-2011-0064730 | A | 6/2011 |
| KR | 20-2011-0008182 | U | 8/2011 |
| KR | 20-0470757 | Y1 | 1/2014 |

* cited by examiner

Prior Art

Prior Art

Prior Art

Prior Art

FOUNDATION CONTAINER PROVIDED WITH DISCHARGE PUMP HAVING SHORT STROKE DISTANCE AND CONTENT SPREADING MEMBER

TECHNICAL FIELD

The present invention relates to a foundation container provided with a discharge pump having a short stroke distance and a content spreading member and, more specifically, to a foundation container provided with a discharge pump having a short stroke distance and a content spreading member, the discharge pump having the short stroke distance as a deformable pressure member acts as both a cylinder and an opening/closing valve, and the content spreading member being at the upper end of the discharge pump, thereby allowing contents to be evenly spread through an impregnated member.

BACKGROUND ART

A container according to the related art contains powder-type contents, which are used by using a puff. However, when the powder-type contents are used, the contents are scattered in use so that the adhesion is deteriorated when the contents are coated on a face. To solve the problem, gel-type foundation has been developed and the frequency of using it has been gradually increased because of the convenience for use.

In general, cosmetics are manufactured by mixing mutually different materials having mutually different specific gravity, and the cosmetic materials may be classified into water-in-oil (W/O) emulsion type cosmetic material and oil-in-water (O/W) emulsion type cosmetic material obtained by mixing water-based material and oil-based material such as an emulsifying agent including a surface active agent.

The water-in-oil emulsion type cosmetic material has a larger quantity of oil than that of water and is oily so that the absorption of skin is slow. Although the touch feeling of the water-in-oil emulsion type cosmetic material is heavy, the persistence is longer than that of the oil-in-water emulsion type cosmetic material. The oil-in-water emulsion type cosmetic material has a larger quantity of water than that of oil and is little oily so that the absorption of skin is fast. Although the touch feeling of the water-in-oil emulsion type cosmetic material is flash and light, the persistence is low. Therefore, the cosmetics requiring persistence are manufactured by using the W/O emulsion type cosmetic material to increase water resistance against sweat and water.

Although the touch feeling of the W/O emulsion type cosmetic material is heavy and sticky, the defects may be compensated by reducing the viscosity of content. However, when the water-in-oil product having low viscosity remains for a long time in circulation, the aqueous material of internal phase and the oil materials of external phase may be separated from each other. In this case, a user shakes a container to mix the separated aqueous and oil materials with each other for use, but it is inconvenient to shake the container for use.

To solve the problems, as shown in FIG. 1, there has been disclosed a product in Korean Patent Application No. 10-2012-0067819, where water-in-oil contents having low viscosity are impregnated into an impregnated member to be contained in an airless pump container.

As shown in FIG. 1, the impregnated member 2000 in which the gel-type foundation is impregnated is contained in a container main body 1000. To use the gel-type foundation impregnated into the impregnated member 2000, vacuum pressure is generated in the container main body 1000 through the pumping operation of the airless pump 4000 by pushing a push button 5000 so that a push plate 3000 at a lower portion of the container main body 1000 is lifted up. Thus, the impregnated member 2000 into which the gel-type foundation is impregnated is compressed upward while being diminished by the push plate 3000, so that the gel-type foundation is discharged.

However, since the volume of the impregnated member 2000 is great, it is difficult for the push plate 3000 to fully lift up the impregnated member 2000 only by the pumping operation of the airless pump 4000. Therefore, it is difficult to fully use the gel-type foundation impregnated into the impregnated member 2000, so that the contents are wasted.

Thus, as shown in FIG. 2, to prevent the gel-type foundation from being residual, there has been proposed a compact container having an airless pump in Korean Registered Utility Model No. 20-0461424.

Although the compact container having an airless pump prevents contents from being residual in a container main body 1000 by using the airless pump 4000, since the airless pump of the compact container according to the related art must use an operating piston 4200 and a sealing piston 4300 due to its structure, the stroke distance is long and, when the airless pump is installed in a flat container such as a compact, the airless pump must be manufactured to have a short stroke distance, so that the discharge amount at a time is small, so pumping must be performed several times to obtain a desired amount. In addition the structure of the airless pump 4000 is complex so that the manufacturing cost is increased.

For reference, the structure of the airless pump will be described as follows. As shown in FIGS. 3 and 4, the structure of the airless pump includes an opening/closing part 4120 for opening or closing the content introduction hole 4100 and the operating piston 4200 installed to receive the elastic force of the elastic member 4400. A cylinder is installed in the pump main body 4800 such that the operating piston 4200 presses the content storage room 4500 to allow the contents in the content storage room 4500 to be discharged through the push button 5000.

The sealing piston 4300 is additionally installed to the operating piston 4200 and a push button 5000 is installed to an operating tube 47000 coupled to the operating piston 4200 of the cylinder 4600.

According to the content discharge pump of the related art having the above described configuration, when the push button 500 is pushed, after a pore is first created between the sealing piston 4300 and the operating piston 4200, the sealing piston 4300 and the operating piston 4200 move down together to generate pressure in a content storage room 4500, so that the contents are discharged through a content transfer path 4220 of the operating piston 4200 by the pressure.

In this case, an opening/closing part 4120 is tightly closed to a content introduction hole 4100 by a compressed elastic member 4400 to shut off the content introduction hole 4100.

After the push button 5000 is pushed to discharge the contents as described above, when the pressure on the push button 5000 is removed, as shown in FIG. 4, the operating piston 4200 and the sealing piston 4300 move up together by the repulsive elastic force accumulated in the elastic member 4400.

At the initial raising stage of the operating piston 4200 and the sealing piston 4300 described above, while the sealing piston 4300 is stopped due to the friction of the sealing piston 4300 and the inside of the cylinder 4600, the operating piston 4200 first moves up, so that the pore created between the operating piston 4200 and the sealing piston 4300 is closed, so that the content transfer path 4220 is shut off and the elastic force accumulated in the elastic member 4400 is weakened.

As described above, in the state that the content transfer path 4220 is shut off, as the operating piston 4200 and the sealing piston 4300 continuously move up by the elastic member 4400, vacuum pressure is generated in the content storage room 4500 and the opening/closing part 4120 is spaced apart from the content introduction hole 4100 by the vacuum pressure generated in the content storage room 4500, so that the contents in the container are introduced into the content storage room 4500.

The content discharge pump according to the related art repeats the above-described operation so that the contents are discharged.

However, the structure of the content discharge pump according to the related art is very complex so that the productivity is deteriorated and the product price is increased. In addition, since the stroke distance of the discharge pump is long due to its structure, when the discharge pump is applied to a product such as a compact, the height of which is less than the width thereof, the space in which the discharge pump is installed is small, so that it is difficult to install the discharge pump. When the discharge pump is manufactured in a small size to solve the problem, the discharge amount of contents is too small so that the pumping must be performed several times to obtain a desired amount of contents.

In addition, although the foundation container having an airless pump according to the related art prevents gel-type foundation from being residual therein, the foundation container does not have any foundations of suitably mixing the separated aqueous and oil materials of the gel-type foundation with each other. Thus, it is inconvenient in use because a consumer must shake the foundation container to mix the aqueous and oil materials with each other.

DISCLOSURE

Technical Problem

To solve the problems described above, an object of the present invention is to provide a foundation pump which includes a deformable pressure member serving as a cylinder and an opening/closing valve and a discharge pump having a short stroke distance to be smoothly operated even in a short stroke distance.

In addition, another object of the present invention is to provide a foundation container which includes an impregnated member provided on an upper end of a discharge pump such that the separated aqueous and oil materials are uniformly mixed with each other.

In addition, still another object of the present invention is to provide a foundation container which is capable of uniformly mixing gel-type contents when the gel-type contents are discharged by an impregnated member, so that the foundation container is not required to be shaken for use.

In addition, still another object of the present invention is to provide a foundation container which includes a content spreading member provided on an upper end of the discharge pump to uniformly spread the contents over an impregnated member so that the contents having a uniform concentration may be used.

In addition, still another object of the present invention is to provide a foundation container which is capable of discharging gel-type contents by using a discharge pump so that the contents are prevented from being residual therein and which is capable of fully using the gel-type contents so that the contents are prevented from being wasted.

In addition, still another object of the present invention is to provide a foundation container which includes a discharge pump having a simple structure to be easily manufactured, so that the productivity is improved and the product price is reduced.

Technical Solution

The present invention provides a foundation container provided with a discharge pump having a short stroke distance and a content spreading member, which includes an outer container main body (100) and an outer container lid (150) hinge-coupled to the outer container main body (100) to be opened or closed. The foundation container includes:

an inner container main body (300) formed inside the outer container main body (100);

an inner container lid (400) for covering an upper part of the inner container main body (300);

an inner container shielding plate (350) coupled to an upper inside of the inner container main body (300);

the discharge pump (600) coupled to a central portion of the inner container shielding plate (350);

a content spreading member (700) coupled to an upper portion of the discharge pump (600); and an impregnated member (800) coupled to an upper portion of the content spreading member (700).

The discharge pump (600) is configured such that when a push button (50) is pushed downward, a deformable pressure member (60) is pressed, deformed, and moved downward, causing the volume of a temporary repository (TR) to decrease and pressure to be generated in the temporary repository (TR). Consequently, a valve plate (40) closes a content outlet (242), and a valve protrusion wheel (62), which is in contact with a content opening/closing piece (513), is widened due to the pressure, causing the contents in the temporary repository (TR) to be discharged through an outlet (51) by passing through a space between the content opening/closing piece (513) and the valve protrusion wheel (62). When the pressure on the push button (50) is removed, the push button (50) is moved upward by the restoring force of an elastic member (70), and the deformable pressure member (60) pressed by the push button (50) is restored to the original state thereof. Thus, the pressure generated in the temporary repository (TR) disappears, and vacuum pressure is generated, causing the closure of the space between the valve protrusion wheel (62) of the deformable pressure member (60) and the content opening/closing piece (513). As the central part of the valve plate (40) is raised upward due to the vacuum pressure, the boundaries of opening/closing lines (41) are widened. Accordingly, the contents inside the container (10) are transferred to the temporary repository (TR) through a space between the valve plate (40) and the content outlet (242), and at this moment, the contents, which have passed through the content outlet (242), are transferred into the temporary repository (TR) through the gaps in the widened opening/closing lines (41) of the valve plate (40). When the vacuum pressure in the temporary repository (TR) disappears following the transfer of the contents, the widened opening/closing lines (41) are restored to the original state thereof and closed due to the elastic force of the valve plate (40), causing the valve plate (40) to close the content outlet (242).

In addition, the foundation container may further include a sealing auxiliary ring (320) coupled to the inside of the inner container main body (300) to enhance sealing force.

In addition, the inner container main body (300) according to the present invention may be formed integrally with the outer container main body (100).

In addition, the foundation container may further include a sealing ring (360) coupled to the outer circumferential surface of the inner container shielding plate (350) to enhance sealing force.

Preferably, the foundation container may further include a fixing part (330) coupled to the upper side of the inner container main body (300) to prevent the inner container shielding plate (350), the content spreading member (700) and the impregnated member (800) from being separated from one another.

In addition, the foundation container may further include a puff storage space (410) formed on the upper portion of the inner container lid (400) and a puff lid (420) formed over the puff storage space (410).

Preferably, a puff (900) is contained in the puff storage space (410) of the inner container lid (400).

Advantageous Effects

According to the foundation container provided with a discharge pump having a short stroke distance and a content spreading member of the present invention, the deformable pressure member serves as a cylinder and an opening/closing valve and a discharge pump having a short stroke distance so that the discharge pump may be smoothly operated even in a short stroke distance.

In addition, according to the foundation container of the present invention, the impregnated member is provided on an upper end of a discharge pump such that the separated aqueous and oil materials are uniformly mixed with each other.

In addition, according to the foundation container of the present invention, the gel-type contents may be uniformly mixed with each other when the gel-type contents are discharged by an impregnated member, so that the foundation container may be conveniently used because the foundation container is not required to be shaken for use.

In addition, according to the foundation container of the present invention, the content spreading member is provided on an upper end of the discharge pump to uniformly spread the contents over an impregnated member so that the contents having a uniform concentration may be used.

In addition, according to the foundation container of the present invention, since the discharging gel-type contents is discharged by the discharge pump, the contents may be prevented from being residual therein, so that the gel-type contents may be fully used, thereby preventing the contents from being wasted.

In addition, according to the foundation container of the present invention, since the discharge pump has a simple structure, the discharge pump may be easily manufactured, so that the productivity may be improved and the product price may be reduced.

BEST MODE

Mode for Invention

Hereinafter, a foundation container provided with a discharge pump having a short stroke distance and a content spreading member according to the present invention will be described with reference to accompanying drawings.

Figure 1:
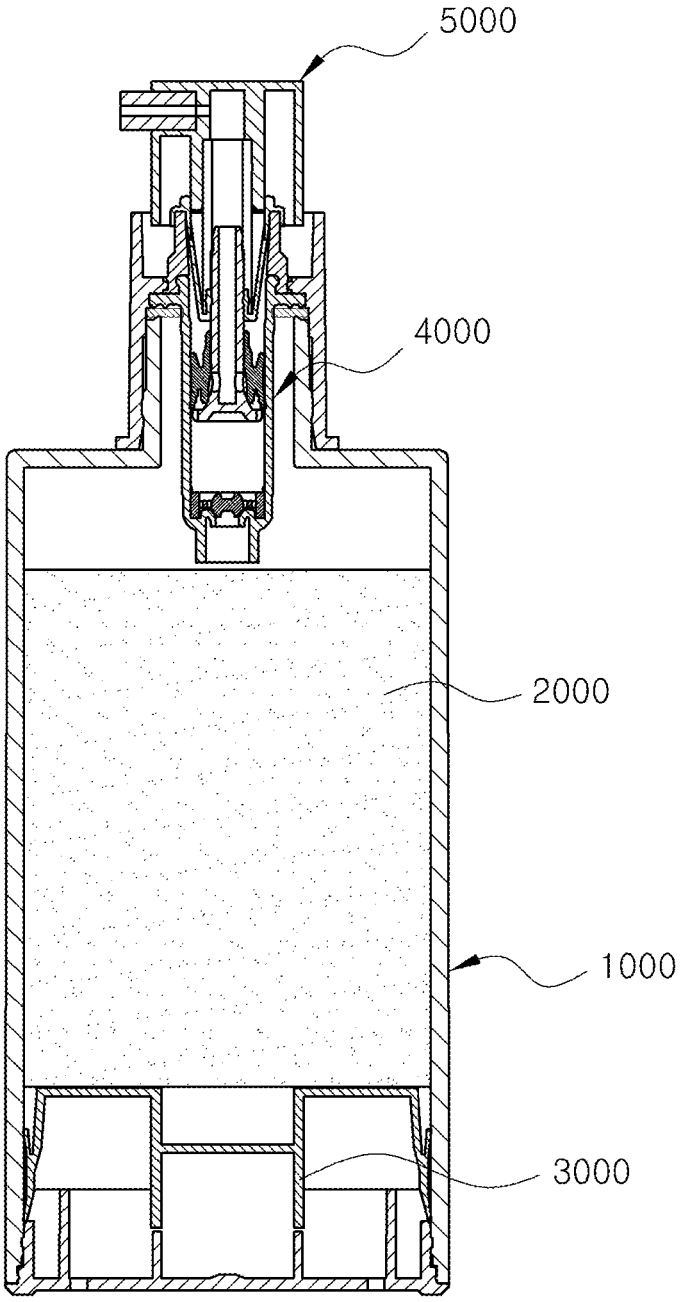
FIG. 1 is a sectional view of a cosmetic container having an impregnated member according to the related art.
Figure 2:
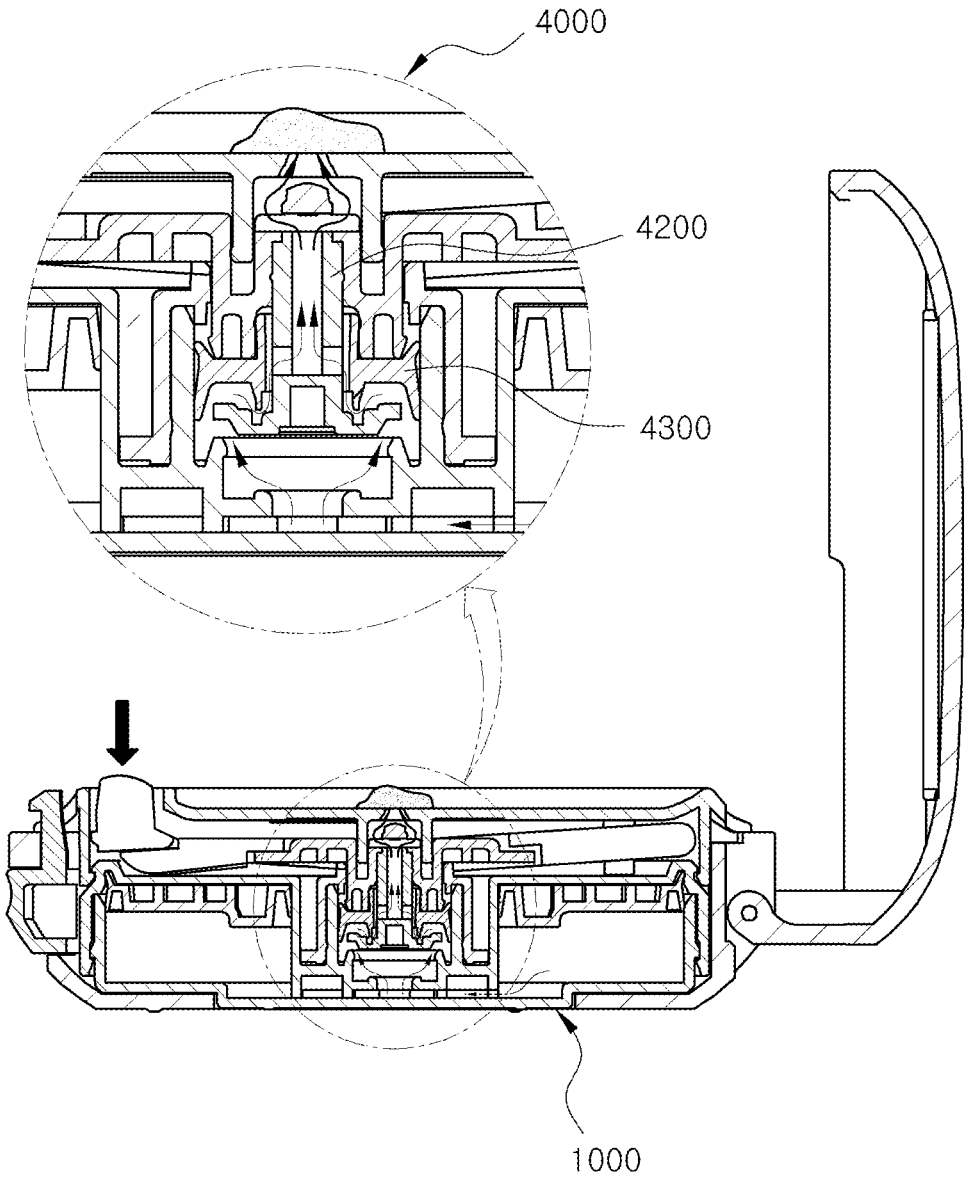
FIG. 2 is a sectional view showing a compact container having an airless pump according to the related art.
Figure 3:
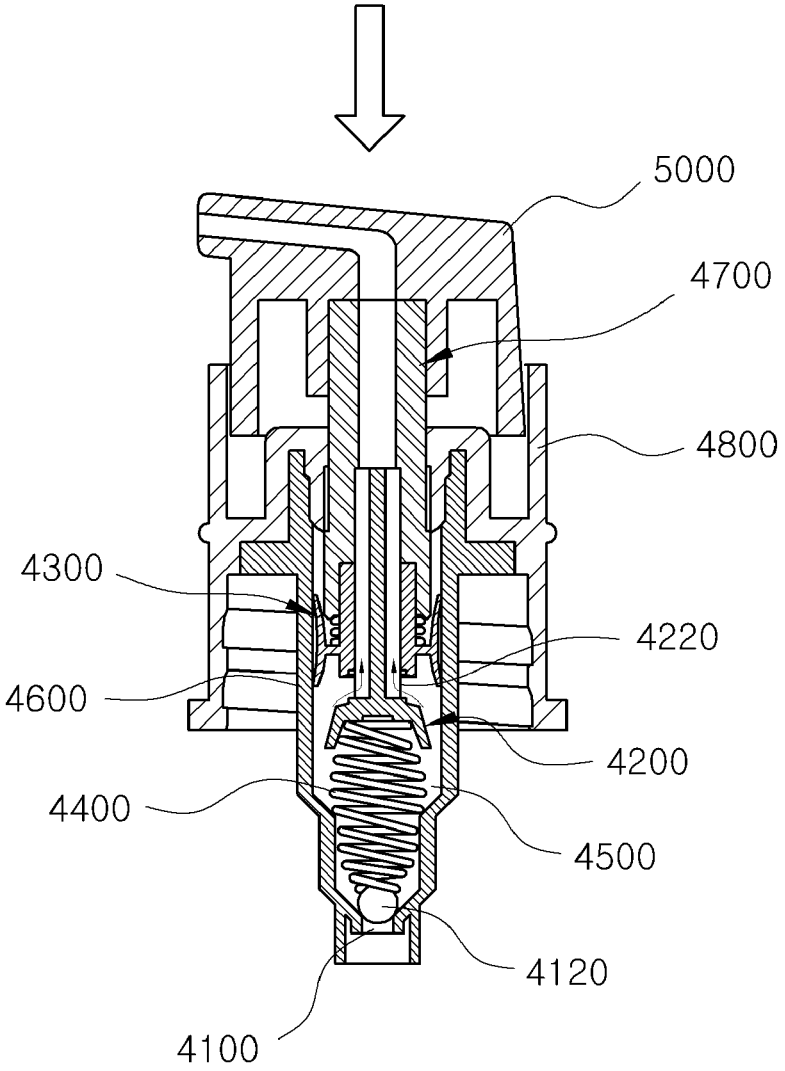
FIG. 3 is an exemplary view showing a state that contents are discharged by operating a content discharge pump according to the related art.
Figure 4:
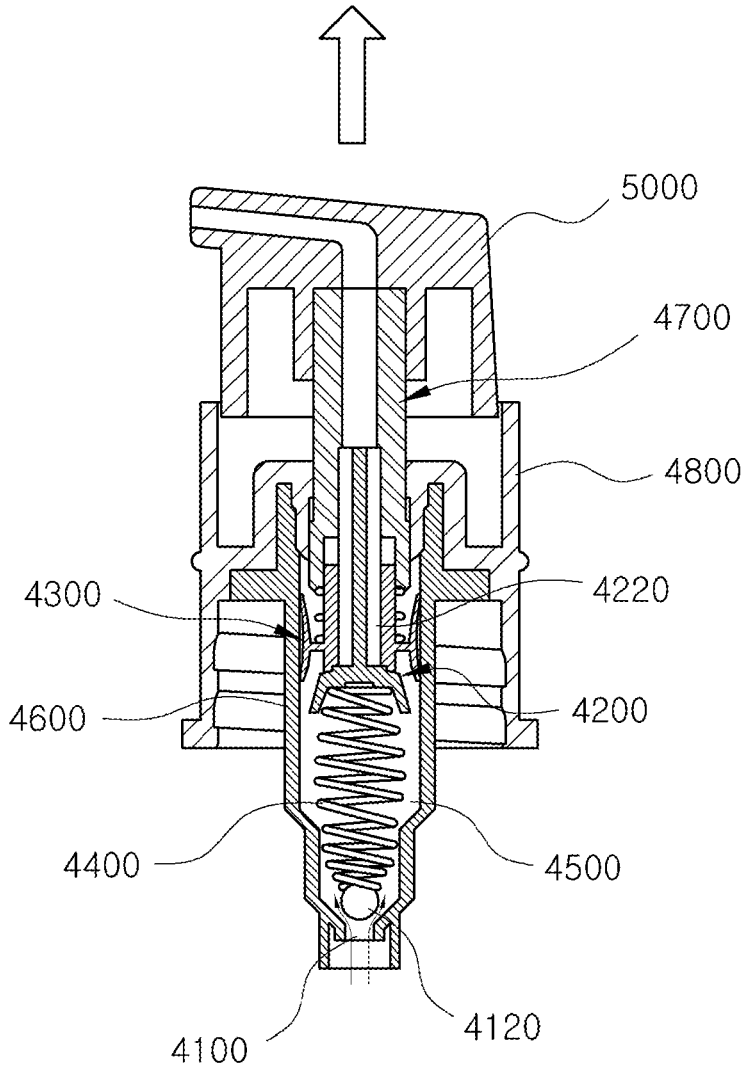
FIG. 4 is an exemplary view showing a state that a content discharge pump is restored to an original state when pressure on the content discharge pump is removed according to the related art.
Figure 5:
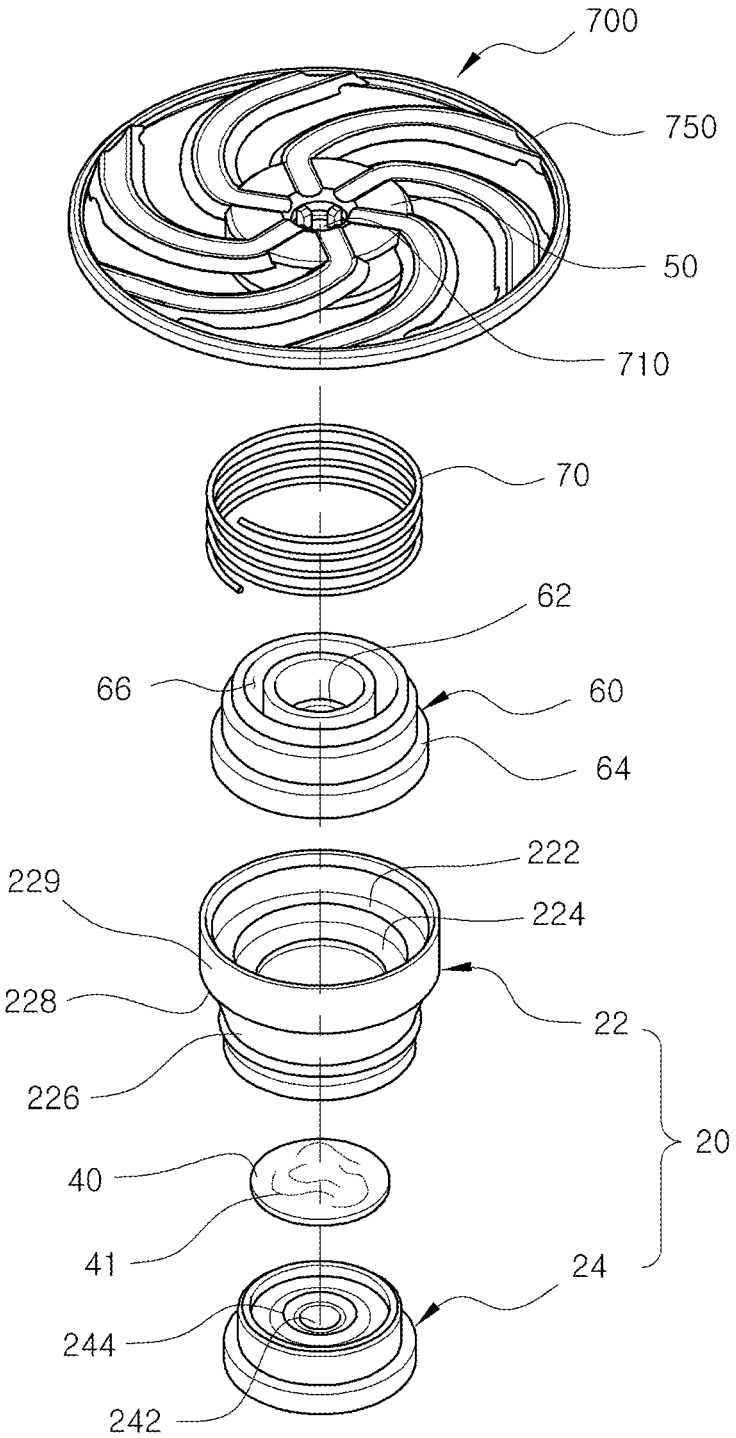
FIG. 5 is an exploded perspective view showing a discharge pump of a foundation container according to a first embodiment of the present invention.
Figure 6:
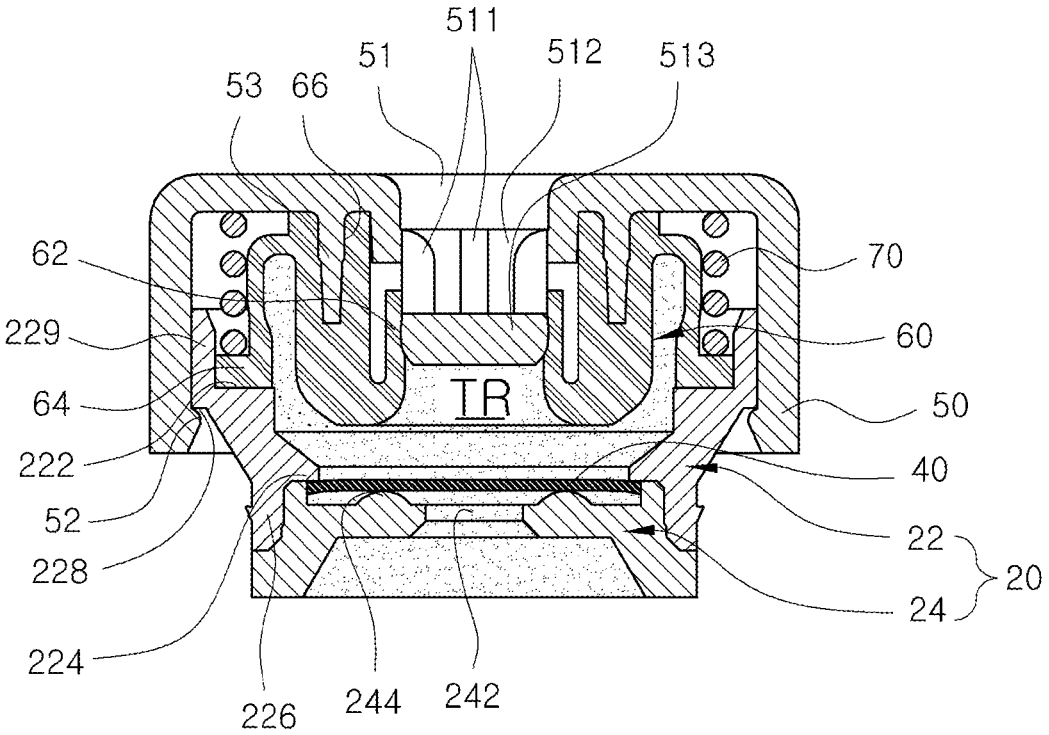
FIG. 6 is a sectional view showing an assembled discharge pump of the foundation container according to the first embodiment of the present invention.
Figure 7:
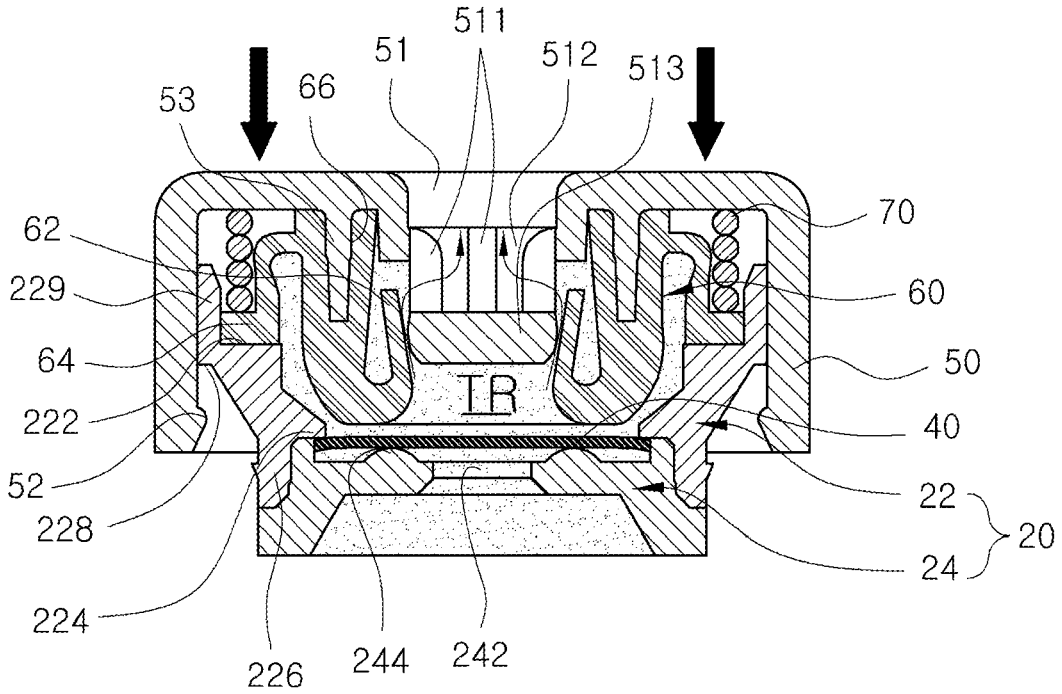
FIG. 7 is a sectional view showing a state of pressing the discharge pump of the foundation container according to the first embodiment of the present invention.
Figure 8:
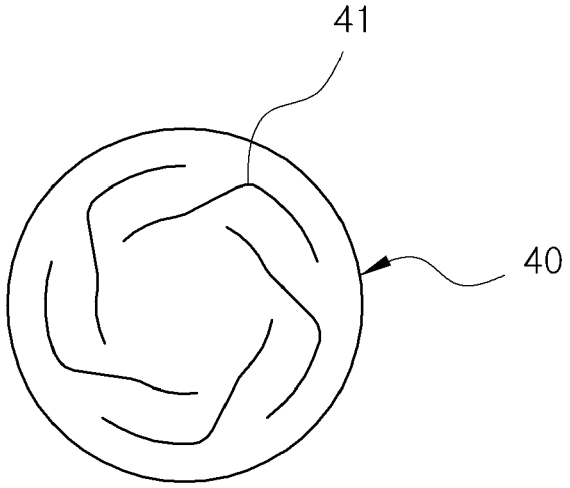
FIG. 8 is a plan view of a valve plate applied to a foundation container according to the present invention.
Figure 9:
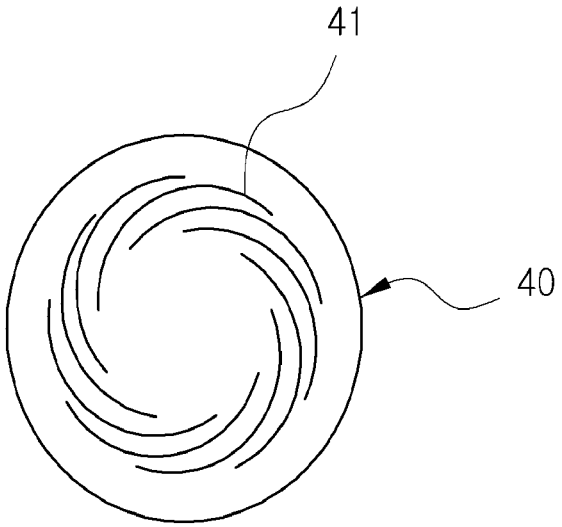
FIGS. 9 and 10 are exemplary views of valve plates applied to a foundation container according to the present invention.
Figure 10:
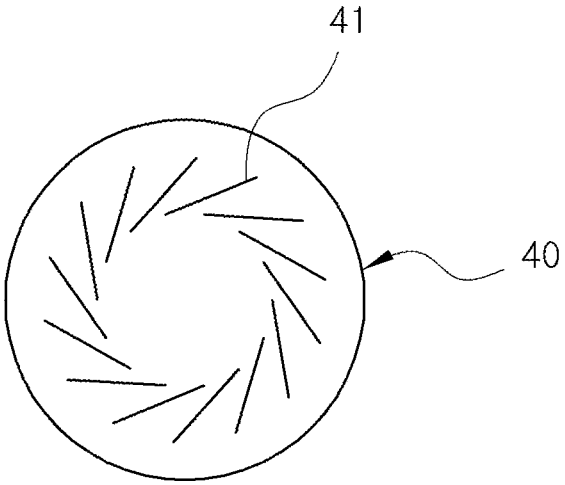
Figure 11:
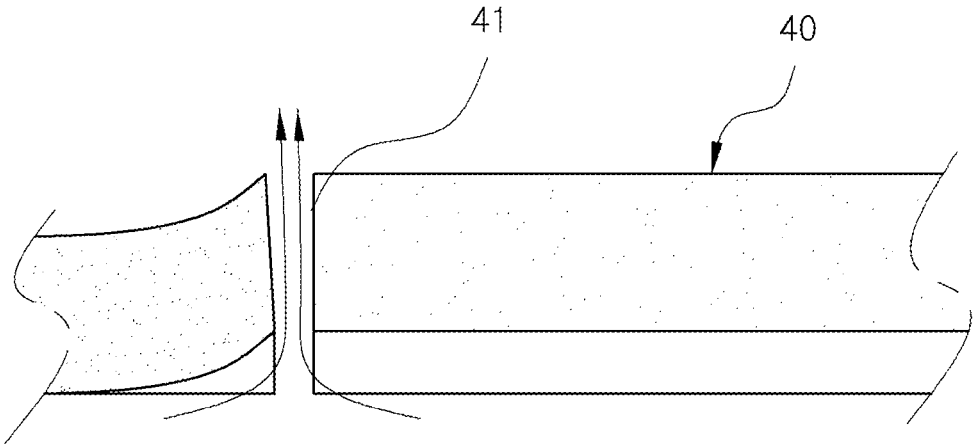
FIG. 11 is a sectional view showing a state that the opening/closing lines of a valve plate applied to a foundation container according to the present invention.
Figure 12:
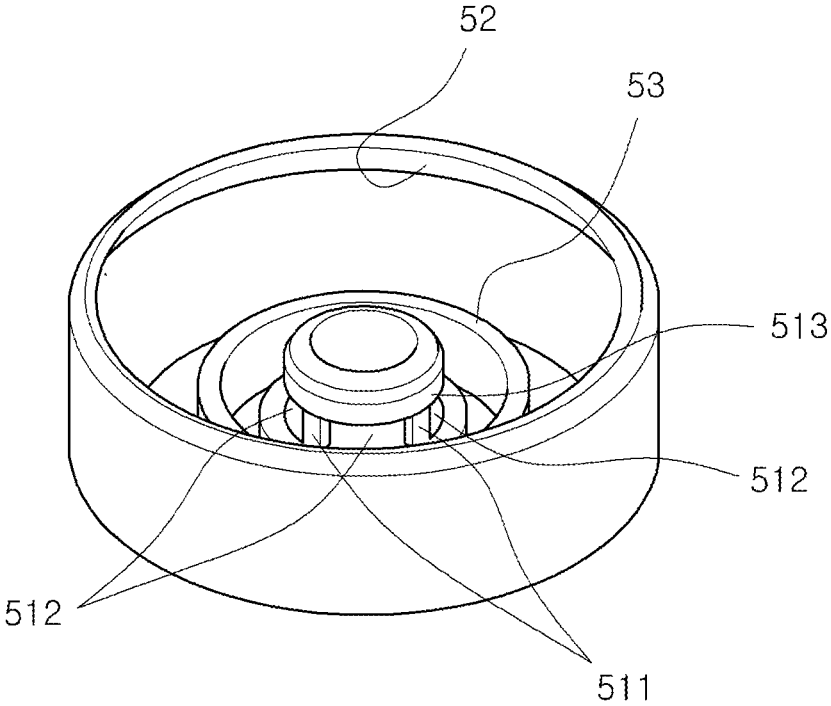
FIG. 12 is a perspective view showing the bottom surface of a push button of a foundation container according to the present invention.
Figure 13:
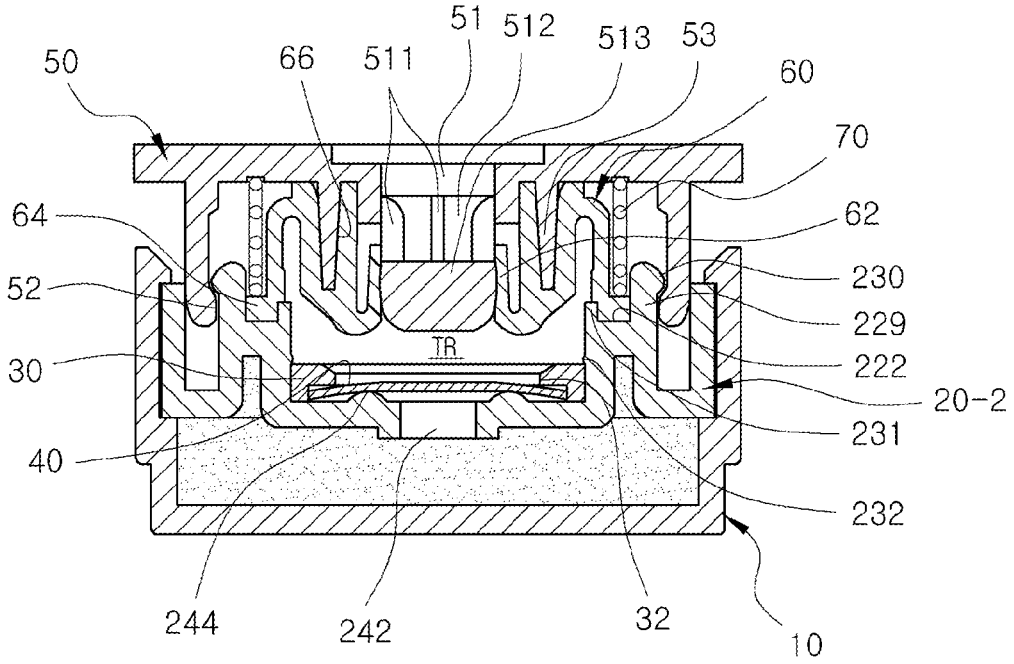
FIG. 13 is a sectional view showing a discharge pump of a foundation container according to a second embodiment of the present invention.
Figure 14:
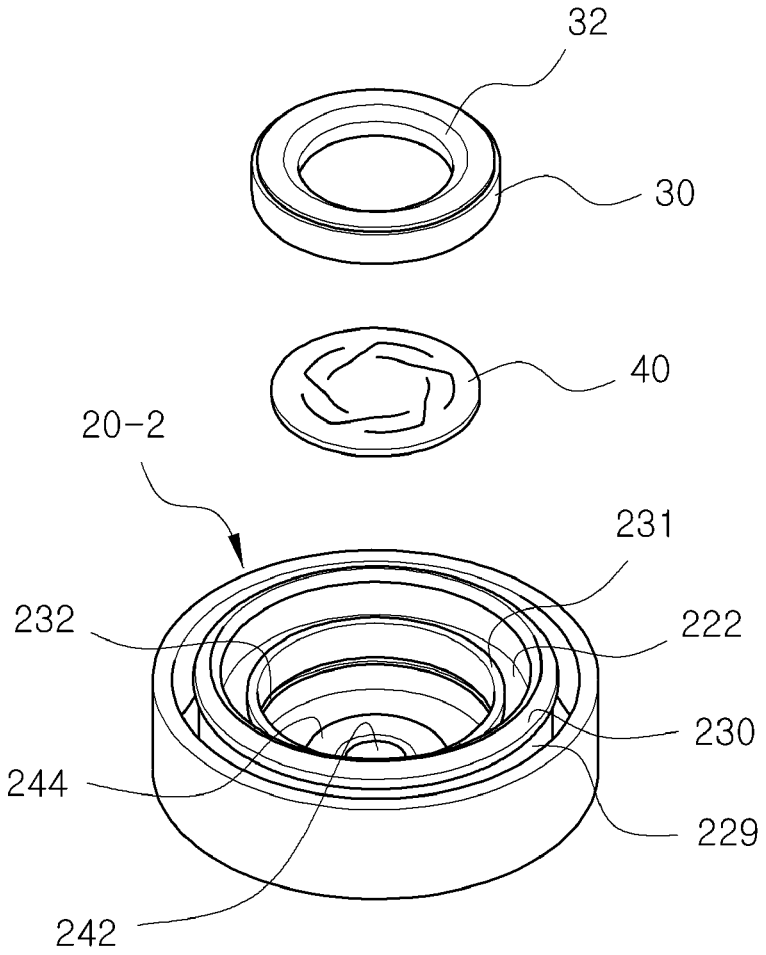
FIG. 14 is a perspective view showing a valve main body, a valve plate and a valve plate fixing member applied to the discharge pump of the foundation container according to the second embodiment of the present invention.
Figure 15:
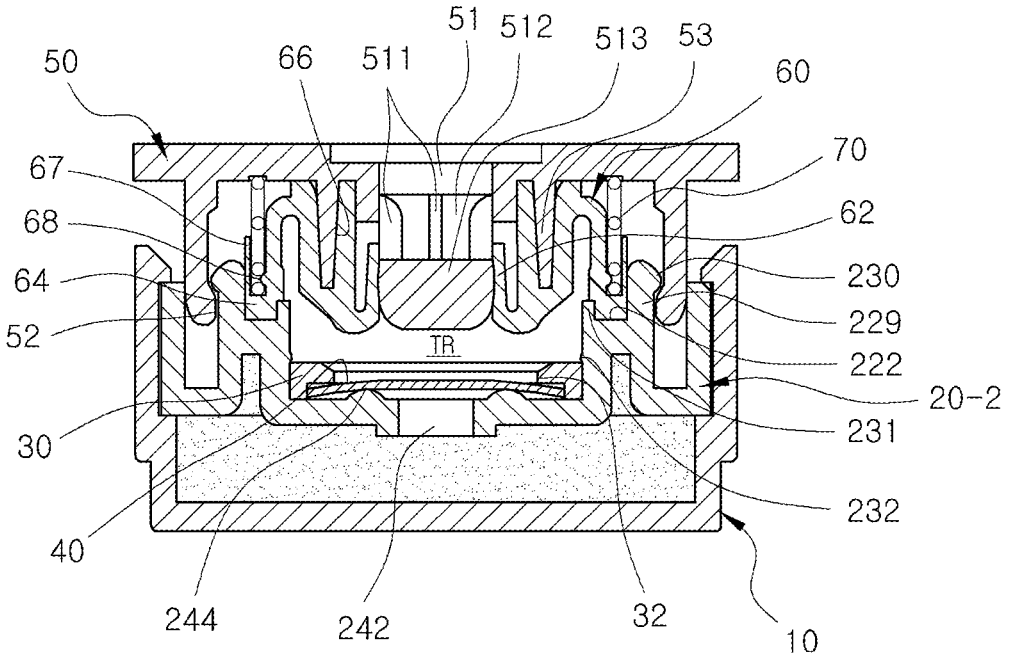
FIG. 15 is a sectional view showing a discharge pump of a foundation container according to a third embodiment of the present invention.
Figure 16:
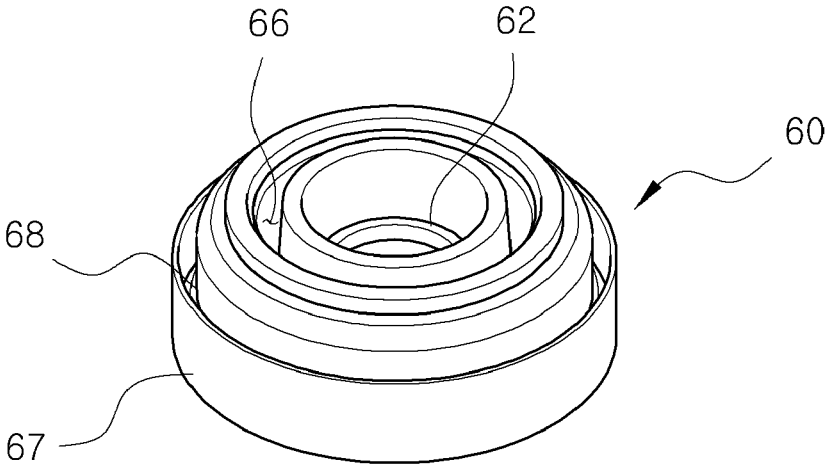
FIG. 16 is a perspective view of a deformable pressure member applied to the discharge pump according to the third embodiment of the present invention.
Figure 17:
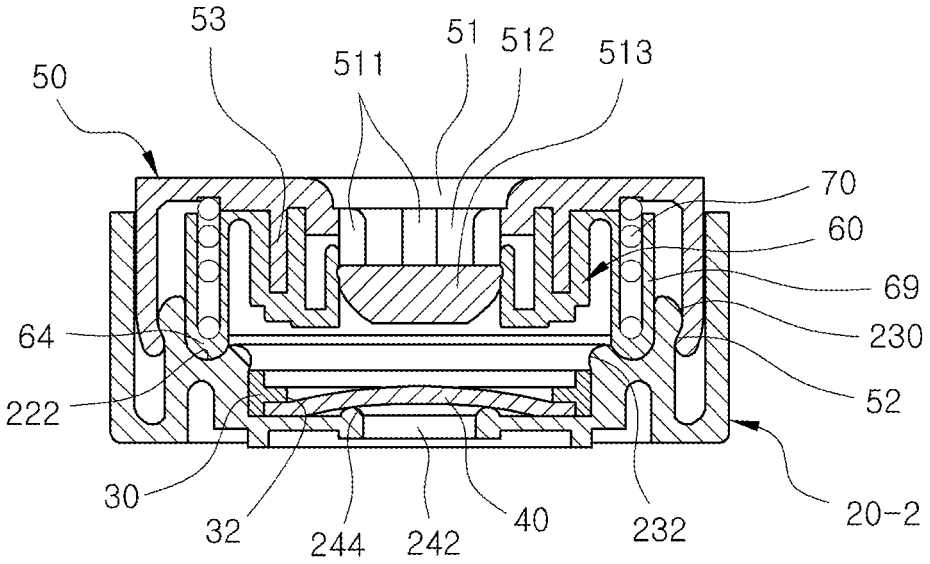
FIG. 17 is a sectional view showing a discharge pump of a foundation container according to a fourth embodiment of the present invention.
Figure 18:
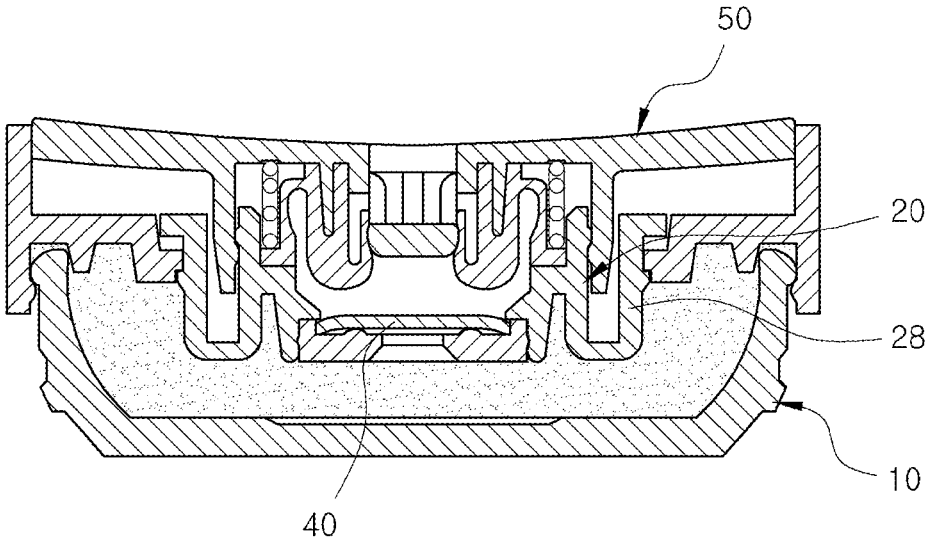
FIG. 18 is a sectional view showing a discharge pump of a foundation container according to a fifth embodiment of the present invention.
Figure 19:
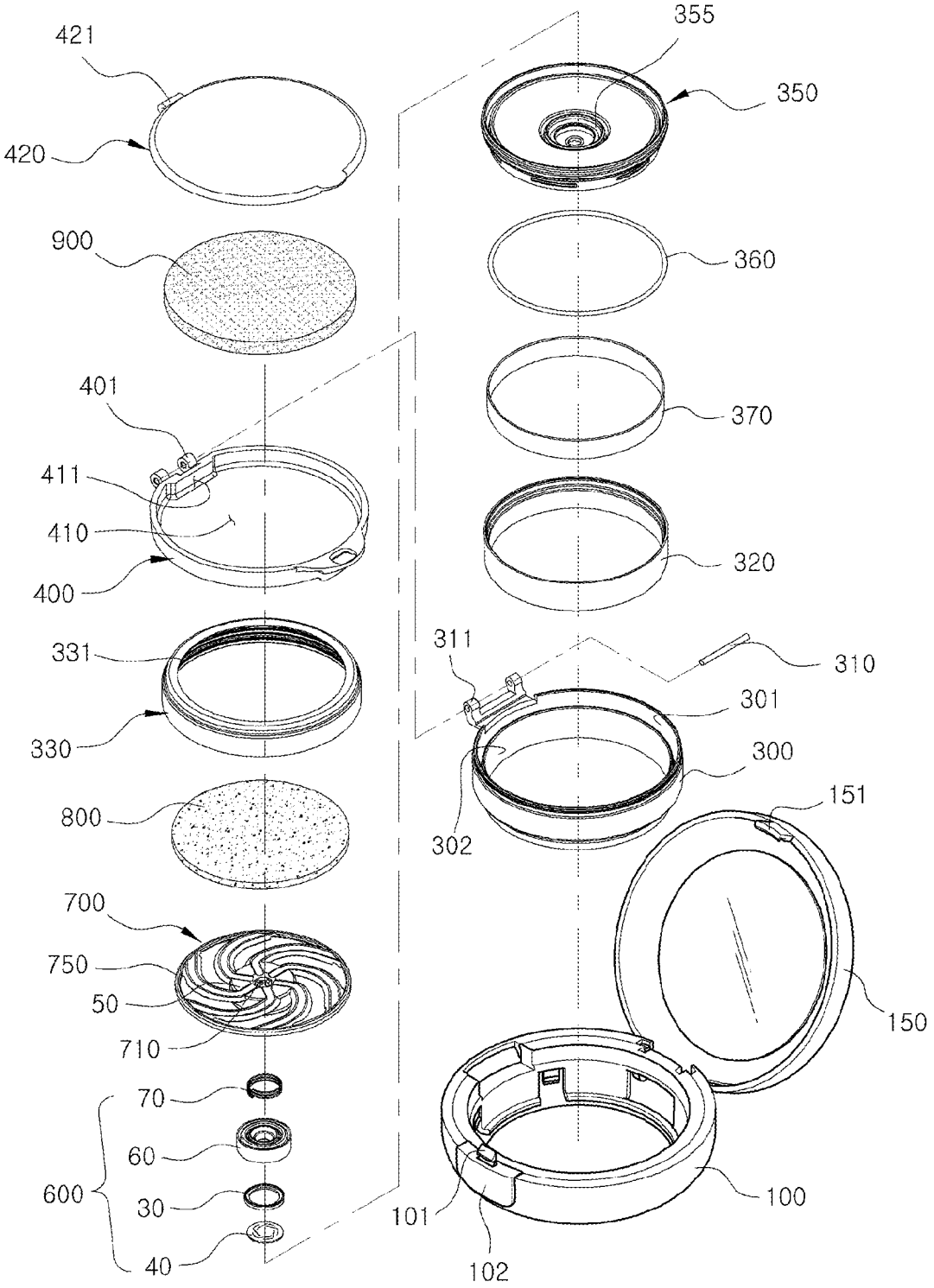
FIG. 19 is an exploded perspective view showing a foundation container according to the present invention.
Figure 20:
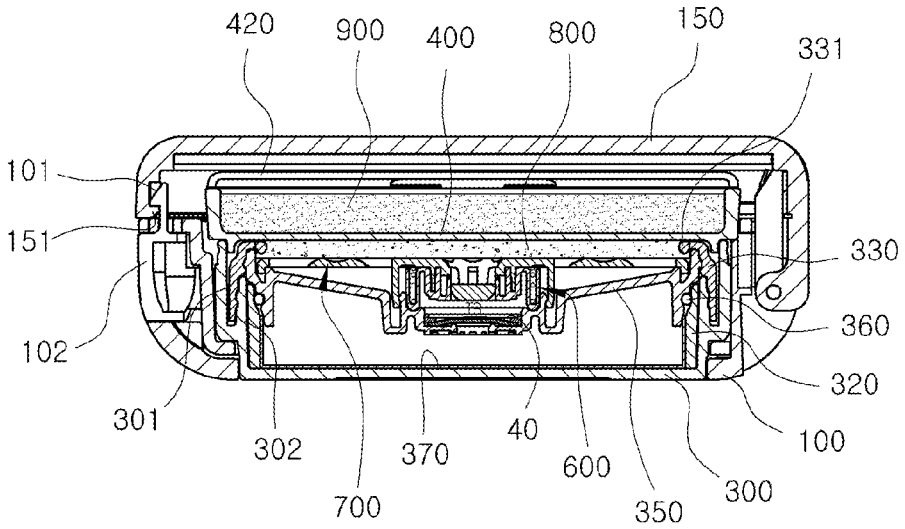
FIG. 20 is a sectional view showing an entire foundation container according to the present invention.
Figure 21:
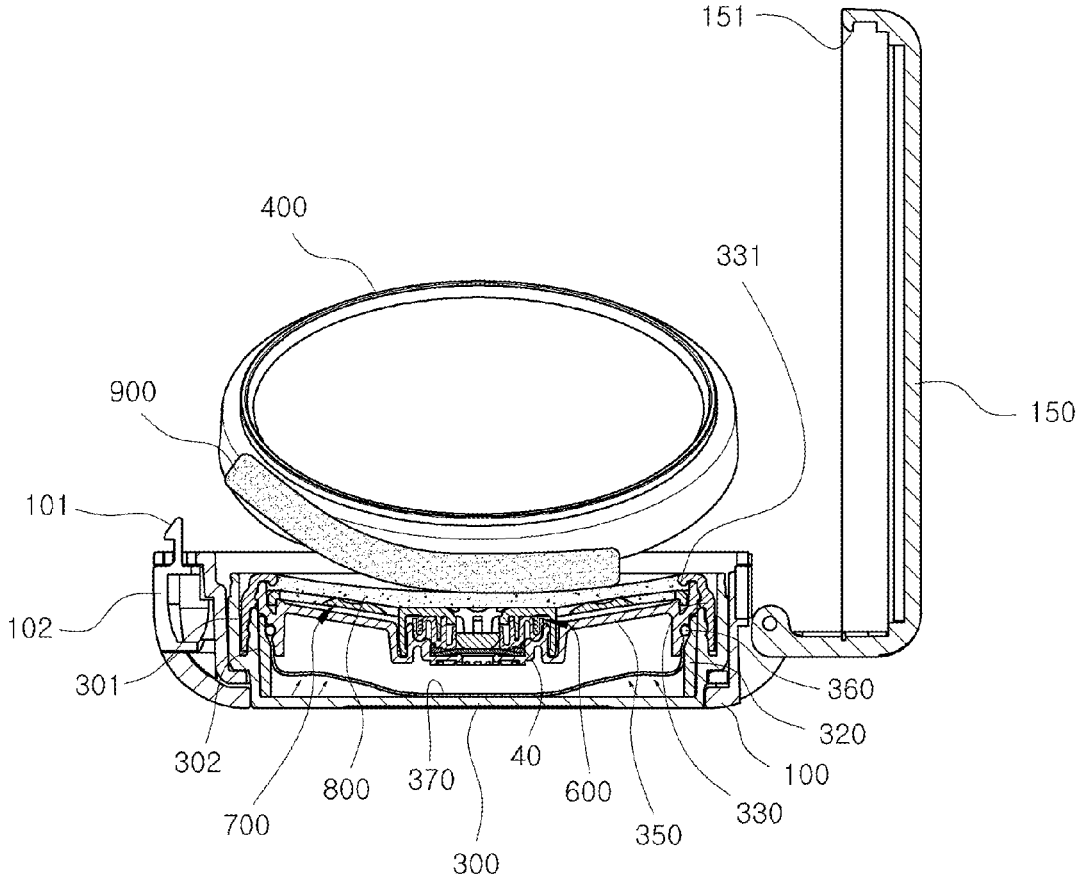
FIG. 21 is a view showing a using state of a foundation container according to the present invention.
Figure 22:
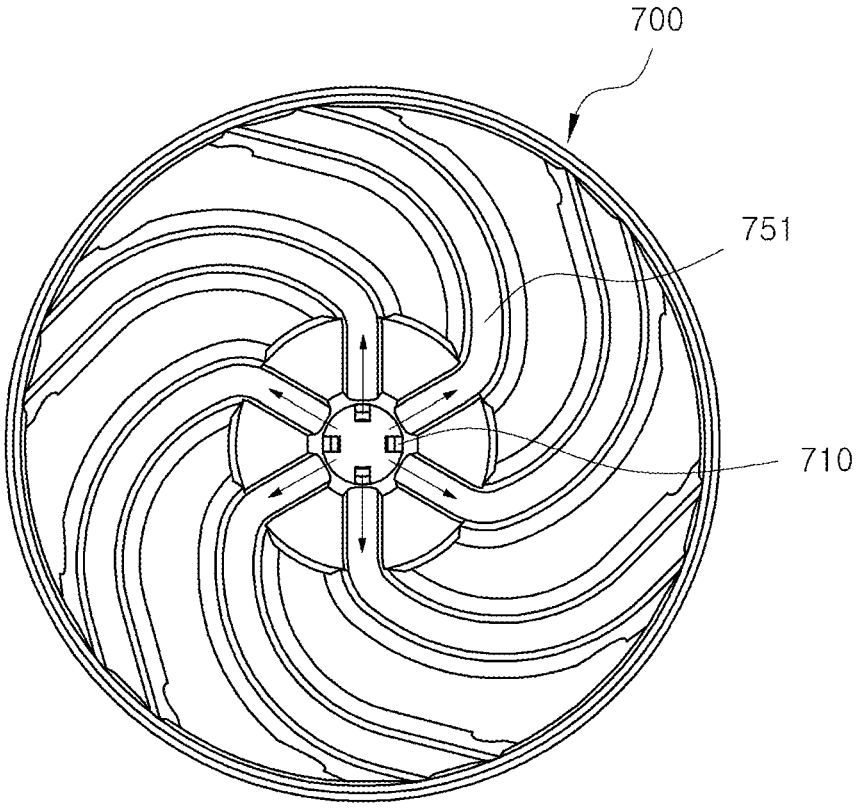
FIG. 22 is a plan view of a content spreading member of a foundation container according to the present invention.

FIG. 5 is an exploded perspective view showing a discharge pump of a foundation container according to a first embodiment of the present invention. FIG. 6 is a sectional view showing an assembled discharge pump of the foundation container according to the first embodiment of the present invention. FIG. 7 is a sectional view showing a state of pressing the discharge pump of the foundation container according to the first embodiment of the present invention. FIG. 8 is a plan view of a valve plate applied to a foundation container according to the present invention. FIGS. 9 and 10 are exemplary views of valve plates applied to a foundation container according to the present invention. FIG. 11 is a sectional view showing a state that the opening/closing lines of a valve plate applied to a foundation container according to the present invention. FIG. 12 is a perspective view showing the bottom surface of a push button of a foundation container according to the present invention. FIG. 13 is a sectional view showing a discharge pump of a foundation container according to a second embodiment of the present invention. FIG. 14 is a perspective view showing a valve main body, a valve plate and a valve plate fixing member applied to the discharge pump according to the second embodiment of the present invention. FIG. 15 is a sectional view showing a discharge pump of a foundation container according to a third embodiment of the present invention. FIG. 16 is a perspective view of a deformable pressure member applied to the discharge pump according to the third embodiment of the present invention. FIG. 17 is a sectional view showing a discharge pump of a foundation container according to a fourth embodiment of the present invention. FIG. 18 is a sectional view showing a discharge pump of a foundation container according to a fifth embodiment of the present invention. FIG. 19 is an exploded perspective view showing a foundation container according to the present invention. FIG. 20 is a sectional view showing an entire foundation container according to the present invention. FIG. 21 is a view showing a using state of a foundation container according to the present invention. FIG. 22 is a plan view of a content spreading member of a foundation container according to the present invention.

The present invention provides a foundation container provided with a discharge pump having a short stroke distance and a content spreading member, which includes an outer container main body 100 and an outer container lid 150 hinge-coupled to the outer container main body 100 to be opened or closed. The foundation container includes:

an inner container main body 300 formed inside the outer container main body 100;

an inner container lid 400 for covering an upper part of the inner container main body 300;

an inner container shielding plate 350 coupled to an upper inside of the inner container main body 300;

the discharge pump 600 coupled to a central portion of the inner container shielding plate 350;

a content spreading member 700 coupled to an upper portion of the discharge pump 600; and an impregnated member 800 coupled to an upper portion of the content spreading member 700.

The discharge pump 600 is configured such that when a push button 50 is pushed down, a deformable pressure member 60 is pressed, deformed, and moved downward, causing the volume of a temporary repository TR to decrease and pressure to be generated in the temporary repository TR. Consequently, a valve plate 40 closes a content outlet 242, and a valve protrusion wheel 62, which is in contact with a content opening/closing piece 513, is widened due to the pressure, causing the contents in the temporary repository TR to be discharged through an outlet 51 by passing through a space between the content opening/closing piece 513 and the valve protrusion wheel 62. When the pressure on the push button 50 is removed, the push button 50 is moved upward by the restoring force of an elastic member 70, and the deformable pressure member 60 pressed by the push button 50 is restored to the original state thereof. Thus, the pressure generated in the temporary repository TR disappears, and vacuum pressure is generated, causing the closure of the space between the valve protrusion wheel 62 of the deformable pressure member 60 and the content opening/closing piece 513. As the central part of the valve plate 40 is raised upward due to the vacuum pressure, the boundaries of opening/closing lines 41 are widened. Accordingly, the contents in the container 10 are transferred to the temporary repository TR through a space between the valve plate 40 and the content outlet 242, and at this moment, the contents, which have passed through the content outlet 242, are transferred into the temporary repository TR through the gaps in the widened opening/closing lines 41 of the valve plate 40. When the vacuum pressure in the temporary repository TR disappears following the transfer of the contents, the widened opening/closing lines 41 are restored to the original state thereof and closed due to the elastic force of the valve place 40, causing the valve plate 40 to close the content outlet 242.

In addition, a sealing auxiliary ring (320) may be further coupled to the inside of the inner container main body 300 of the present invention in order to enhance sealing force.

In addition, the inner container main body 300 of the present invention may be formed integrally with the outer container main body 100.

In addition, a sealing ring 360 may be further coupled to the outer circumferential surface of the inner container shielding plate 350 of the present invention in order to enhance sealing force.

Preferably, a fixing part 330 may be further coupled to the upper side of the inner container main body 300 of the present invention in order to prevent the inner container shielding plate 350, the content spreading member 700 and the impregnated member 800 from being separated from one another.

In addition, a puff storage space 410 may be further formed on the upper portion of the inner container lid 400 of the present invention and a puff lid 420 may be further formed over the puff storage space 410.

Preferably, a puff 900 is contained in the puff storage space 410 of the inner container lid 400 of the present invention.

The inner container main body 300 is contained in the outer container main body 100, and the button 102 allows a latching protrusion 101 extending from an upper portion of the button 102 to be easily drawn back by the pushing operation of a user, such that the latching protrusion 101 is separated from a hook 151 of the outer container lid 150.

The outer container lid 150, which covers an upper portion of the outer container main body 100, is hinge-coupled to the outer container main body 100 to open or close the outer container main body 100.

The hook 151, which has a protrusion shape to correspond to the latching protrusion 101, is formed at one side of the outer container lid 150.

An auxiliary container 370 for containing contents is provided in the inner container main body 300 and is formed of a material which is thin and easily deformable. The auxiliary container 370 may be formed of one of vinyl, synthetic resin, general rubber, elastomer, silicon rubber and NBR rubber.

The auxiliary container 370 may be formed with the inner container main body 300 through a dual molding scheme, or may be assembled after being separately formed.

The inner container main body 300 includes an outer wall 301, an inner wall 302 and a hinge bracket 311 for coupling with the inner container lid 400.

The inner container main body 300 may be formed integrally with the outer container main body 100, but the inner container main body 300 formed separately from the outer container main body 100 is described in this embodiment.

A sealing auxiliary ring 320 is further coupled to the inside of the inner container main body 300 to enhance sealing force.

The sealing auxiliary ring 320 may be formed of one of general rubber, elastomer, silicon rubber, NBR rubber and synthetic resin having excellent elasticity.

The outer and inner walls 301 and 302 form the side surface of the inner container main body 300 and a space is formed between the outer and inner walls 301 and 302.

The hinge bracket 311 is formed on one side surface of the outer wall 301 such that the hinge bracket 311 is hinge-coupled to the inner container lid 400 covering the inner container main body 300 by using a hinge pin 310.

The inner container shielding plate 350 is placed on an upper end of the inner container main body 300 and is provided at the center thereof with a discharge pump coupling hole 355, such that the contents contained in the inner container main body 300 is prevented from being leaked.

The discharge pump 600 is coupled into the discharge pump coupling hole 355 formed at the center of the inner container shielding plate 350 to discharge the contents upward.

The sealing ring 360 may be further coupled to the cuter circumferential surface of the inner container shielding plate 350 to enhance sealing force.

The sealing ring 360 may be formed of one of general rubber, elastomer, silicon rubber, NBR rubber and synthetic resin having excellent elasticity.

The discharge pump 600 is placed in the discharge pump coupling hole 355 of the inner container shielding plate 350.

Hereinafter, the discharge pump 600 coupled to the foundation container provided with a discharge pump having a short stroke distance and a content spreading member according to the present invention will be described in detail.

As shown in FIGS. 5 to 7, the discharge pump 600 applied to the foundation container according to the first embodiment of the present invention is coupled into the discharge pump coupling hole 351 of the inner container shielding plate 350 and includes a valve main body 20, a valve plate 40, the push button 50, the deformable pressure member 60 and the elastic member 70.

The valve main body 20 includes a valve upper body 22 and a valve lower body 24. A receiving sill 222 is formed on an upper surface of the valve upper body 22 and a support sill 224 protrudes from an inner middle portion of the valve upper body 22. A valve lower body coupling part 226 extends integrally and downward from the inner middle portion of the valve upper body 22 and a latching sill 228 is formed on an outer circumference of the valve upper body 22. An extension protrusion wheel 229 may extend upward and outward from the valve main body 20 and be formed integrally with the valve main body 20. The extension protrusion wheel 229 guides the deformable pressure member 60 and the elastic member 70 to be safely placed on the valve upper body 22.

The valve lower body 24 is provided at the center thereof with a content outlet 242 and a ring-shaped protrusion part 244 protrudes from an outer circumference of the content outlet 242. After the valve plate 40 is placed on the valve lower body 24, the valve lower body 24 is inserted into the valve lower body coupling part 226 of the valve upper body 22 to be coupled to the valve upper body 22.

The valve lower body 24 may be coupled to the valve upper body 22 through an under-cut scheme, a forcible fitting scheme or a thermal bonding scheme. When the valve lower body 24 is inserted into the valve lower body coupling part 226 of the valve upper body 22 while the valve plate 40 is placed on the valve lower body 24, a valve plate supporting sill 224 of the valve upper body 22 presses the outer circumference of the valve plate 40 to allow the valve plate 40 to be tightly closed to the ring-shaped protrusion part 244 of the valve lower body 24, so that the content outlet 242 is sealed.

The valve plate 40 has a flat shape, is coupled between the valve upper body 22 and the valve lower body 24 of the valve main body 20, and is provided with a plurality of opening/closing lines 41.

The valve plate 40 may be formed of one of general rubber, elastomer, silicon rubber, NBR rubber and synthetic resin having excellent elasticity.

The opening/closing line 41 may be a wave-shaped cutting line as shown in FIG. 8, a circular-shaped cutting line as shown in FIG. 9, or a diagonal-sharped cutting line as shown in FIG. 10. The shape of the opening/closing line 41 is not limited to a specific shape, and the opening/closing line 41 may have any shapes if the opening/closing line 41 of the valve plate 40 can be elastically opened and closed.

When the push button 50 is pushed to generate pressure in the temporary repository TR, the valve plate 40 is tightly closed to the ring-shaped protrusion part 244 of the valve lower body 24 so that the opening/closing lines 41 are closed. When the pressure on the push button 50 is removed so that the push button 50 moves upward by the elastic member 70 to generate vacuum pressure in the temporary repository TR, as shown in FIG. 11, the central part of the valve plate 40 is raised upward due to the vacuum pressure to allow the gaps of the opening/closing lines 41 to be widened, so that the contents are introduced from the container 10 to the temporary repository TR through the gaps of the opening/closing lines 41.

The push button 50 is coupled to the outer circumference of the valve upper body 22. The push button 50 is provided at the center thereof with an outlet 51 through which the contents are discharged and provided on the inner circumferential lower end thereof with the latching sill 52. A plurality of ribs 511 is formed in the outlet 51. The content opening/closing piece 513 is formed integrally with a lower end of the rib 511. A content passage 512 is formed between the ribs 511, so that the contents are discharged through the content passage 512 when the contents are discharged from the temporary repository TR to the outlet 51.

When the push button 50 is coupled while covering the valve upper body 22, the push button 50 is forcibly fitted into the valve upper body 22 such that the latching sill 52 of the push button 50 is latched to the latching sill 228 while passing through an outside of the extension protrusion wheel 229.

As shown in FIG. 12, a coupling rib 53 is formed to an inside of the push button 50 and coupled to the deformable pressure member 60.

The deformable pressure member 60 is coupled to the inside of the push button 50 and a coupling sill 64 protrudes from the outer circumference of the deformable pressure member 60. The coupling sill 64 is placed on the receiving sill 222 of the valve upper body 22 and a valve protrusion wheel 62 is formed on the central portion of the deformable pressure member 60.

The deformable pressure member 60 is safely placed on the valve upper body 22 so that an inner space is formed between the deformable pressure member 60 and the valve main body 20, where the inner space is the temporary repository TR in which the contents remain until the contents are discharged through the outlet 51 of the push button 50 after moving from the container 10 through the valve main body 20.

A coupling groove 66 is formed on an upper surface of the deformable pressure member 60 and the coupling rib 53 o the push button 50 is inserted into the coupling groove 66. The coupling rib 53 may be coupled into the coupling groove 66 through an under-cut scheme, a press-fitting scheme or a thermal bonding scheme, or by using adhesive.

After the coupling sill 64 of the deformable pressure member 60 is placed on the receiving sill 222 of the valve upper body 22, the coupling sill 64 is tightly closed to the receiving sill 222 of the valve upper body 22 by pressing the coupling sill 64 with the elastic member 70. In this case, the extension protrusion wheel 229 of the valve upper body 22 guides the receiving sill 64 of the deformable pressure member 60 to be in place.

The valve protrusion wheel 62 of the deformable pressure member 60 has a cylindrical shape. The content opening/closing piece 513 of the push button 50 is tightly fitted into the valve protrusion wheel 62 to control the discharge of contents. Preferably, a diameter of the valve protrusion wheel 62 is less than that of the content opening/closing piece 513, such that the valve protrusion wheel 62 presses the content opening/closing piece 513. Preferably, the diameter of the valve protrusion wheel 62 is less than that of the content opening/closing piece 513 by 0.1 mm to 5.0 mm.

Thus, when the push button 50 is not pressed, since the pressure is not generated in the temporary repository TR, the valve protrusion wheel 62 is pressed due to its elasticity so that the sealing is continuously maintained. However, as shown in FIG. 7, when the push button 50 is pushed to increase the pressure in the temporary repository TR, the valve protrusion wheel 62 pressing the content opening/closing piece 513 is opened due to the pressure on the content opening/closing piece 513 to discharge the contents.

The deformable pressure member 60 may be formed of one of general rubber, elastomer, silicon rubber, NBR rubber and synthetic resin having excellent elasticity.

The elastic member 70 is placed on the latching sill 64 formed on an edge of the deformable pressure member 60 to fix the coupling sill 64 of the deformable pressure member 60 while pressing the coupling sill 64 onto the receiving sill 222 o the pump upper body 22, so that the air tightness is improved and the push button 50 is elastically supported. The elastic member 70 may be a coil spring.

The elastic member 70 may be formed of one of synthetic resin, elastomer, rubber and metal. When the elastic member 70 is formed of synthetic resin, elastomer or rubber, the foundation container according to the present invention may be separately collected after use for the purpose of waste recycling.

The above-described discharge pump 600 is operated as follows.

The discharge pump 600 is coupled to the foundation container for containing contents according to the present invention for use.

As shown in FIG. 7, according to the discharge pump 600, the deformable pressure member 60 is pressed to be deformed so that the deformable pressure member 60 moves down. In this case, the coupling sill 64 of the deformable pressure member 60 is pressed by the elastic member 70 while being placed on the receiving sill 222 of the valve upper body 22, so that the deformable pressure member 60 is fixed and the sealing is enhanced.

When the push button 50 moves down, although the coupling sill 64 of the deformable pressure member 60 is fixed, the remaining parts except for the coupling sill 64 move down by a predetermined distance.

Thus, since the pressure is generated in the temporary repository TR as the volume of the temporary repository TR is reduced, the valve plate 40 is tightly closed to the ring-shaped protrusion part 244 near the content outlet 242 and the valve protrusion wheel 62 tightly closed to the content opening/closing piece 513 is opened due to the pressure, so that the contents in the temporary repository TR are discharged through the content passage 512 and the outlet 51 while passing between the content opening/closing piece 513 and the valve protrusion wheel 62.

Thereafter, when the pressure on the push button 50 is removed, the push button 50 moves up by the restoring force of the elastic member 70 and the deformable pressure member 60 pressed by the push button (50) is restored to the original state thereof.

As the pressure generated in the temporary repository TR disappears, the valve protrusion wheel 62 of the deformable pressure member 60 is tightly closed to the content opening/closing piece 513 again, so that the space between the valve protrusion wheel 62 and the content opening/closing piece 513 is closed.

Thereafter, when the push button 50 continuously moves up to generate the vacuum pressure in the temporary repository TR, the space between the valve protrusion wheel 62 of the deformable pressure member 60 and the content opening/closing piece 51*c* is continuously closed and, as shown in FIG. 11, due to the vacuum pressure, the central portion of the valve plate 40 is lifted up so that the opening/closing lines 41 are opened.

Thus, the contents in the container 10 are transferred into the temporary repository TR while passing between the valve plate 40 and the content outlet 242. In this case, the contents passing through the content outlet 242 are transferred into the temporary repository TR through the gaps of the opening/closing lines 41 of the valve plate 40.

When the contents moves so that the vacuum pressure in the temporary repository TR disappears, the widened opening/closing lines (41) are restored to the original states thereof and closed due to the elastic force of the valve plate 40, so that the valve plate 40 closes the content outlet 242.

Hereinafter, a discharge pump applied to the foundation container according to the second embodiment of the present invention will be described.

FIG. 13 is a sectional view showing a discharge pump 600 of a foundation container according to a second embodiment of the present invention. FIG. 14 is a perspective view showing a valve main body, a valve plate and a valve plate fixing member applied to the discharge pump 600 of the foundation container according to the second embodiment of the present invention.

As shown in FIGS. 13 and 14, the discharge pump 600 according to the second embodiment is coupled to the foundation container for containing contents and includes a valve main body 20-2, a valve plate fixing member 30, a valve plate 40, a push button 50, a deformable pressure member 60 and an elastic member 70.

Since the valve plate 40, the push button 50, the deformable pressure member 60 and the elastic member 70 are the same as those of the discharge pump according to the first embodiment, the details will be omitted. In the following description, the same elements, structures and functions of the second embodiment as those of the first embodiment will be assigned with the same reference numerals.

A receiving sill 222 is formed on an upper surface of the valve main body 20-2 and an extension protrusion wheel 229 extends integrally and upward from the outer circumference of the receiving sill 22. A latching sill 230 is formed outward of an upper side end of the extension protrusion wheel 229. In addition, an auxiliary extension protrusion wheel 231 may be formed integrally and upward of an inner circumference of the receiving sill 222.

The coupling sill 64 of the deformable pressure member 60 is placed on the receiving sill 222 and the extension protrusion wheel 229 guides the coupling sill 64 of the deformable pressure member 60 to be in place. The auxiliary extension protrusion wheel 231 guides the coupling sill 64 of the deformable pressure member 60 to be in place and improves the sealing.

In addition, a content outlet 242 is formed at the center of the lower end of the valve main body 20-2 and a ring-shaped protrusion part 244 protrudes from an outer circumference of the content outlet 242. A latching sill 232 may protrude from a middle of the inner circumference of the valve main body 20-2.

The valve plate fixing member 30 has a ring shape and is provided on an inner circumference of an upper surface thereof with a valve plate support sill 32.

According to the discharge pump 600 of the second embodiment, after the valve plate 40 is placed on the ring-shaped protrusion part 244 by inserting the valve plate 40 into the valve main body 20-2, the valve plate fixing member 30 is inserted into the valve main body 20-2 while the circumference of the valve plate 40 is pressed with the valve plate support sill 32, such that the valve plate fixing member 30 is fixed to the valve main body 20-2.

In this case, the valve plate fixing member 30 may be forcibly fitted into the valve main body 20-2 to be fixed to the valve main body 20-2 and may be latched over the latching sill 232 of the valve main body 20-2.

Thereafter, the deformable pressure member 60 is placed on the valve main body 20-2. The coupling sill 64 of the deformable pressure member 60 is placed on the receiving sill 222 of the valve main body 20-2, such that the extension protrusion wheel 229 and the auxiliary extension protrusion wheel 231 of the valve main body 20-2 surround the outer and inner circumferences of the coupling sill 64 of the deformable pressure member 60.

After the elastic member 70 is placed on the coupling sill 64 of the deformable pressure member 60, while the push button 50 is coupled to an upper portion of the deformable pressure member, the coupling rib 53 of the push button 50 is inserted into the coupling groove 66 of the deformable pressure member 60 and the latching sill 52 of the push button 50 is latched over the latching sill 230 of the extension protrusion wheel 229 of the valve main body 20-2.

Since the operation of the discharge pump 600 applied to the foundation container according to the second embodiment of the present invention is the same as that of the discharge pump according to the first embodiment, the details will be omitted.

Hereinafter, a discharge pump applied to the foundation container according to the third embodiment of the present invention will be described.

FIG. 15 is a sectional view showing a discharge pump of a foundation container according to a third embodiment of the present invention. FIG. 16 is a perspective view of a deformable pressure member applied to the discharge pump according to the third embodiment of the present invention.

As shown in FIGS. 15 and 16, the discharge pump 600 according to the third embodiment includes an extension protrusion wheel 67 integrally formed on an outer circumference of the deformable pressure member 60. That is, the deformable pressure member 60 may be applied to the discharge pump according to the first embodiment or the discharge pump according to the second embodiment.

Although FIG. 15 is a sectional view showing the entire deformable protrusion member 60 of the discharge pump 600 according to the third embodiment applied to the discharge pump according to the second embodiment, the embodiment is not limited thereto. Hereinafter, the deformable protrusion member 60 of the discharge pump 600 according to the third embodiment applied to the discharge pump according to the second embodiment will be described with reference to FIG. 15.

As shown in FIG. 15, the discharge pump 600 according to the third embodiment is coupled to the foundation container for containing contents and includes a valve main body 20-2, a valve plate fixing member 30, a valve plate 40, a push button 50, a deformable pressure member 60 and an elastic member 70.

Since the valve main body 20-2 and the valve plate fixing member 30 are the same as those of the discharge pump according to the second embodiment and the valve plate 40, the push button 50 and an elastic member 70 are the same as those of the discharge pump according to the first embodiment, the details will be omitted.

The deformable pressure member 60 includes an extension protrusion wheel 67 extending integrally and upward from an upper side of the outer circumference of the latching sill 64 of the deformable pressure member 60. The extension protrusion wheel 67 guides the elastic member 70 to be easily in place when the elastic member 70 is placed on the coupling sill 64 of the deformable pressure member 60.

In addition, a latching sill 68 is further formed upwardly on an inner circumference of the coupling sill 64. After the elastic member 70 is placed on the latching sill 64 of the deformable pressure member 60, the latching sill 68 prevents the elastic member 70 from being out of the correct place because the elastic member 70 is latched to the latching sill 68.

Since the structure of the discharge pump 600 according to the third embodiment is the same as that of the discharge pump according to the second embodiment except for the deformable pressure member 60, the details will be omitted. In addition, since the operation of the discharge pump according to the third embodiment is the same as that of the discharge pump according to the first embodiment, the details will be omitted.

Hereinafter, a discharge pump applied to the foundation container according to the fourth embodiment of the present invention will be described.

FIG. 17 is a sectional view showing the entire discharge pump of the foundation container according to the fourth embodiment of the present invention.

As shown in FIG. 17, the discharge pump 600 according to the fourth embodiment further includes a long extension protrusion wheel 69 integrally formed on an outer circumference of the deformable pressure member 60, wherein the long extension protrusion wheel 69 has a height equal to a height of an uppermost side surface of the deformable pressure member 60 such that the long extension protrusion wheel 69 surrounds all the elastic member 70. The deformable pressure member 60 constructed as described above may be applied to the discharge pump according to the first embodiment and the discharge pump according to the second embodiment.

Although FIG. 17 is a sectional view showing the entire deformable protrusion member 60 of the discharge pump according to the fourth embodiment applied to the discharge pump according to the second embodiment, the embodiment is not limited thereto and the deformable pressure member 60 is applicable to the discharge pump according to the first embodiment. Hereinafter, the discharge pump according to the fourth embodiment will be described with reference to FIG. 17.

The discharge pump 600 according to the fourth embodiment is coupled to the foundation container for containing contents and includes a valve main body 20-2, a valve plate fixing member 30, a valve plate 40, a push button 50, a deformable pressure member 60 and an elastic member 70.

Since the valve main body 20-2 and the valve plate fixing member 30 are the same as those of the discharge pump according to the second embodiment and the valve plate 40, the push button 50 and an elastic member 70 are the same as those of the discharge pump according to the first embodiment, the details will be omitted.

The discharge pump 600 further includes a long extension protrusion wheel 69 integrally formed on and extending upward from the outer circumference of the coupling sill 64 of the deformable pressure member 60, wherein the long extension protrusion wheel 69 has a height equal to that of the uppermost side surface of the deformable pressure member 60 such that the long extension protrusion wheel 69 surrounds all the elastic member 70.

After the elastic member 70 is placed on the latching sill 64 of the deformable pressure member 60, the long extension protrusion wheel 69 prevents the elastic member 70 from being out of the correct place and sub-serves the elastic operation of the elastic member 70. That is, when the push button 50 is pushed, the elastic force is generated while the long extension protrusion wheel 69 is compressed together with the elastic member 70.

Thereafter, when the pressure on the push button 50 is removed, the push button 50 moves up by the restoring force of the elastic member 70. In this case, the long extension protrusion wheel 69 also pushes the push button 50 together with the elastic member 70 due to the elastic force to raise the push button 50.

Since the structure of the discharge pump according to the fourth embodiment is the same as that of the discharge pump according to the second embodiment except for the deformable pressure member 60, the details will be omitted. In addition, since the operation of the discharge pump according to the fourth embodiment is the same as that of the discharge pump according to the first embodiment, the details will be omitted.

Hereinafter, a discharge pump applied to the foundation container according to the fifth embodiment of the present invention will be described.

FIG. 18 is a sectional view showing the entire discharge pump of the foundation container according to the fifth embodiment of the present invention, where the discharge pump according to the first embodiment is coupled to a flat container 10.

As shown in FIG. 18, the discharge pump of the foundation container according to the fifth embodiment of the present invention may be coupled to the flat container 10 and a coupling protrusion wheel 28 for coupling with the flat container 10 may be further formed on the outmost side of the valve main body 20.

The content spreading member 700 is coupled to an upper portion of the discharge pump 600 and includes a push button 50 and a spreading plate 759 formed on the push button 50.

The content spreading member 700 is provided at the center thereof with a discharge hole 710 through which the contents are discharged.

The spreading plate 750 may be formed on the push button 50 and may be formed integrally with or separately from the push button 50. As shown in FIG. 22, a plurality of wave-sharped spreading passage 751 for uniformly impregnating the contents discharged through the discharge hole 710 into an impregnated member 800 is provided based on the discharge hole 710.

A groove is formed on the spreading passage 751 to allow the contents discharged through the discharge hole 710 to flow therethrough.

The impregnated member 800 is coupled to an upper portion of the content spreading member 700 and the contents are uniformly impregnated by the spreading passage 751 of the spreading member 700 while being spread around.

The impregnated member 800 is an open cell type of foam so that gel-type contents are not separated from each other due to the surface tension of the foam.

The impregnated member 800 may include at least one selected from the group consisting of butadiene rubber (BR), styrene butadiene rubber (SBR), natural rubber (NR), wet urethane, dry urethane, polyether, polyester, polyvinyl chloride, polyethylene, ethylene vinyl acetate (EVA), latex, silicon, styrene isoprene styrene (SIS), styrene ethylene butylene styrene (SEBS), polyvinyl alcohol (PVA), silicone elastomer, nitrile rubber, butyl rubber and neoprene.

As shown in FIG. 20, the fixing part 330 is interposed between the outer and inner walls 301 and 302 of the inner container main body 300 to prevent the inner container shielding plate 350, the content spreading member 700 and the impregnated member 800 from being separated from one another.

A latching ring sill 331 formed on an upper end of the fixing part 330 presses an upper end of the impregnated member 800 to prevent the impregnated member 800 from moving.

A hinge bracket 401 is formed on one side of the inner container lid 400 and a hinge bracket coupling part 411 is formed inside the hinge bracket 401. The inner container lid 400 seals the inner container main body 300 and a puff storage space 410 is provided inside the inner container lid 400 to store a puff 900 serving as a cosmetic tool in the puff storage space 410.

The hinge bracket 401 is coupled to a hinge protrusion 421 of a puff lid 420 to cover the inner container lid 400.

The hinge bracket coupling part 411 is coupled to the hinge bracket 311 of the inner container main body 300 such that the inner container main body 300 and the inner container lid 400 are hinge-coupled to each other to seal the inner container main body 300.

The puff 900 is placed in the puff storage space 410 of the inner container lid 400, and the puff 900 may be formed of one of cotton, fabrics, foam NBR, ruby-cell, polyester, sponge having elasticity and soft urethane, such that a user is prevented from feeling unpleasant when the puff 900 makes contact with user's skin.

The puff lid 420 is provided at one side thereof with a hinge protrusion 421 and is hinge coupled to the inner container lid 400.

The hinge protrusion 421 is fitted into the hinge bracket 401 of the inner container lid 420 and is fixed with a hinge pin 402.

Hereinafter, a method of assembling the foundation container provided with a discharge pump having a short stroke distance and a content spreading member according to the embodiment of the present invention and a using state thereof will be described.

In order to assemble the foundation container provided with a discharge pump having a short stroke distance and a content spreading member according to the present invention, after the inner container main body 300 is fitted into a lower end of the outer container main body 100, the contents are injected into the inner container main body 300. A sealing ring 360 may be further coupled to the inner container main body 300 to enhance the sealing force. Then, the inner container shielding plate 350 coupled to the discharge pump 600 is fixed to the inner container main body 300 to seal the inner container main body 300. The sealing ring 360 is further coupled to the outer circumferential surface of the inner container shielding plate 350 to enhance sealing force. Next, the impregnated member 800 is coupled to an upper portion of the content spreading member 700 after the content spreading member 700 is coupled to the upper portion of the discharge pump 600. The fixing part 330 is installed to prevent the inner container shielding plate 350, the content spreading member 700 and the impregnated member 800 from being separated from one another, and then, the puff 900 is installed in the puff storage space 410 of the inner container lid 400 after the inner container lid 400 is hinge coupled to the inner container main body 300. Then, the puff lid 410 is hinge coupled to the inner container lid 400 so that the assembly of the foundation container provided with a discharge pump having a short stroke distance and a content spreading member according to the present invention is completed.

In order to use the contents in the foundation container provided with a discharge pump having a short stroke distance and a content spreading member according to the present invention, the impregnated member 800 is pressed with the puff 900. When the content spreading member 700 and the discharge pump 600 move down by pressing the impregnated member 800, the deformable pressure member 60 is pushed and deformed to move down, so that the volume of the temporary repository TR is reduced to generate pressure in the temporary repository TR. Thus, the valve plate 40 closes the content outlet 242, and the valve protrusion wheel 62, which is tightly closed to the content opening/closing piece 513, is widened due to the pressure, so that the contents in the temporary repository TR are discharged through the outlet 51 while passing between the content opening/closing piece 513 and the valve protrusion wheel 62.

Thereafter, when the pressure on the impregnated member 800 is removed, the push button 50 of the content spreading member 700 moves upward by the restoring force of the elastic member 70 and the deformable pressure member 60 pressed by the push button 50 is restored to the original state thereof. Thus, the pressure generated in the temporary repository TR disappears, and vacuum pressure is generated, causing the closure of the space between the valve protrusion wheel 62 of the deformable pressure member 60 and the content opening/closing piece 513. As the central part of the valve plate 40 is raised upward due to the vacuum pressure, the boundaries of opening/closing lines 41 are widened.

Thus, the contents inside the container 10 are transferred to the temporary repository TR through the space between the valve plate 40 and the content outlet 242, and at this moment, the contents, which have passed through the content outlet 242, are transferred into the temporary repository TR through the gaps in the widened opening/closing lines 41 of the valve plate 40.

When the contents moves so that the vacuum pressure in the temporary repository TR disappears, the widened opening/closing lines 41 are restored to the original states thereof and closed due to the elastic force of the valve plate 40, so that the valve plate 40 closes the content outlet 242.

The contents discharged by the discharging operation of the discharge pump 600 are discharged to the discharge hole 710 formed in the content spreading member 700 and are transferred to the spreading passage 751.

The contents transferred to the spreading passage 751 are uniformly impregnated in to the entire impregnated member 800.

Thereafter, the contents impregnated into the impregnated member 800 stick on the puff 900 to be used.

The foundation container provided with a discharge pump having a short stroke distance and a content spreading member described in this disclosure is for an illustrative purpose only and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

100: Outer container main body
150: outer container lid
300: inner container main body
310: Hinge pin
320: Sealing auxiliary ring
330: Fixing part
350: inner container shielding plate
360: Sealing ring
400: Inner container lid
410: Puff storage space
420: Puff lid
600: Discharge pump
700: Content spreading member
750: Spreading plate
800: Impregnated member
900: Puff

The invention claimed is:

1. A foundation container which is provided with a discharge pump and a content spreading member and includes an outer container main body (100) and an outer container lid (150) hinge-coupled to the outer container main body (100) to be opened or closed, the foundation container comprising:

an inner container main body (300) formed inside the outer container main body (100);

an inner container lid (400) for covering an upper part of the inner container main body (300);

an inner container shielding plate (350) coupled to an upper inside of the inner container main body (300);

the discharge pump (600) coupled to a central portion of the inner container shielding plate (350);

a content spreading member (700) coupled to an upper portion of the discharge pump (600); and an impregnated member (800) coupled to an upper portion of the content spreading member (700), wherein, when a push button (50) is pushed down, a deformable pressure member (60) of the discharge pump (600) is pressed, deformed and moved downward to decrease a volume of a temporary repository (TR) to generate a pressure in the temporary repository (TR), such that a valve plate (40) closes a content outlet (242) and a valve protrusion wheel (62), which is tightly closed to a content opening/closing piece (513), is widened due to the pressure to allow the contents in the temporary repository (TR) to be discharged through an outlet (51) by passing through a space between the content opening/closing piece (513) and the valve protrusion wheel (62), wherein, when the pressure on the push button (50) is removed, the push button (50) is moved upward by restoring force of an elastic member (70), and the deformable pressure member (60) pressed by the push button (50) is restored to an original state thereof, such that the pressure generated in the temporary repository (TR) disappears to generate a vacuum pressure, thereby allowing the space between the valve protrusion wheel (62) of the deformable pressure member (60) and the content opening/closing piece (513) to be closed and boundaries of opening/closing lines (41) are widened as a central portion of the valve plate is lifted upward due to the vacuum pressure to allow the contents in an auxiliary container (370) to be transferred into the temporary repository (TR) through a space between the valve plate (40) and the content outlet (242), wherein the contents which have passed through the content outlet (242) are transferred into the temporary repository (TR) through gaps in the widened opening/closing lines (41) of the valve plate (40), and wherein, when the vacuum pressure in the temporary repository (TR) disappears due to the transfer of the contents, the widened opening/closing lines (41) are restored to the original state thereof and closed due to the elastic force of the valve plate (40), such that the valve plate (40) closes the content outlet (242).

2. A foundation container which is provided with a discharge pump and a content spreading member, wherein a content is injected into an inner container main body (300) after fitting the inner container main body (300) with an outer container main body (100), an inner container shielding plate (350) coupled to the discharge pump (600) is fixed to the inner container main body (300) to shield the inner container main body (300), and an impregnated member (800) is coupled to an upper portion of a content spreading member (700) after the content spreading member (700) is coupled to an upper portion of the discharge pump (600), wherein, when a push button (50) is pushed down, a deformable pressure member (60) of the discharge pump (600) is pressed, deformed and moved downward to decrease a volume of a temporary repository (TR) to generate a pressure in the temporary repository (TR), such that a valve plate (40) closes a content outlet (242) and a valve protrusion wheel (62), which is tightly closed to a content opening/closing piece (513), is widened due to the pressure to allow the contents in the temporary repository (TR) to be discharged through an outlet (51) by passing through a space between the content opening/closing piece (513) and the valve protrusion wheel (62), wherein, when the pressure on the push button (50) is removed, the push button (50) is moved upward by restoring force of an elastic member (70), and the deformable pressure member (60) pressed by the push button (50) is restored to an original state thereof, such that the pressure generated in the temporary repository (TR) disappears to generate a vacuum pressure, thereby allowing the space between the valve protrusion wheel (62) of the deformable pressure member (60) and the content opening/closing piece (513) to be closed and boundaries of opening/closing lines (41) are widened as a central portion of the valve plate is lifted upward due to the vacuum pressure to allow the contents in an auxiliary container (370) to be transferred into the temporary repository (TR) through a space between the valve plate (40) and the content outlet (242), wherein the contents which have passed through the content outlet (242) are transferred into the temporary repository (TR) through gaps in the widened opening/closing lines (41) of the valve plate (40), and wherein, when the vacuum pressure in the temporary repository (TR) disappears due to the transfer of the contents, the widened opening/closing lines (41) are restored to the original state thereof and closed due to the elastic force of the valve plate (40), such that the valve plate (40) closes the content outlet (242).

3. A foundation container which is provided with a discharge pump and a content spreading member and includes an outer container main body (100) and an outer container lid (150) hinge-coupled to the outer container main body (100) to be opened or closed, the foundation container comprising:

an inner container main body (300) formed inside the outer container main body (100);

an inner container lid (400) for covering an upper part of the inner container main body (300);

an inner container shielding plate (350) coupled to an upper inside of the inner container main body (300);

the discharge pump (600) coupled to a central portion of the inner container shielding plate (350);

a content spreading member (700) coupled to an upper portion of the discharge pump (600); and an impregnated member (800) coupled to an upper portion of the content spreading member (700), wherein the discharge pump (600) includes:

a valve main body (20) having a valve upper body (22) and a valve lower body (24) coupled to each other, a receiving sill (222) formed on an upper surface of the valve upper body (22), and a content outlet (242) formed at a center of the valve lower body (24);

a valve plate (40) coupled between the valve upper body (22) and the valve lower body (24) of the valve main body (20);

a push button (50) coupled to an upper portion of the valve upper body (22) and provided on a central portion thereof with an outlet (51) for discharging the contents therethrough, in which a content opening/closing piece (513) is formed at a lower inside of the outlet (51);

a deformable pressure member (60) coupled to an inside of the push button (50), placed on the valve upper body (22) and provided on a central portion thereof with a valve protrusion wheel (62); and an elastic member (70) for pressing an outer circumferential surface end of the deformable pressure member (60) and elastically supporting the push button (50).

4. The foundation container of claim 1, wherein the discharge pump (600) includes:

a valve main body (20-2) having the content outlet (242) formed at a center thereof and a receiving sill (222) formed on an upper surface thereof;

a valve plate fixing member (30) coupled to an inside of the valve main body (20-2), having a ring shape and provided on an inner circumferential portion of an upper surface thereof with a valve plate support sill (32), wherein the valve plate (40) is coupled between the valve main body (20-2) and the valve plate fixing member (30), wherein the push button (50) is coupled to an upper portion of a valve upper body (22) and provided on a central portion thereof with the outlet (51) for discharging the contents therethrough, in which the content opening/closing piece (513) is formed at a lower inside of the outlet (51), wherein the deformable pressure member (60) is coupled to an inside of the push button (50), placed on the valve upper body (22) and provided on a central portion thereof with the valve protrusion wheel (62), and wherein the elastic member (70) is constructed for pressing an outer circumferential surface end of the deformable pressure member (60) and elastically supporting the push button (50).

5. The foundation container of claim 1, wherein the discharge pump (600) includes:

a valve main body (20) having a valve upper body (22) and a valve lower body (24) coupled to each other, a receiving sill (222) formed on an upper surface of the valve upper body (22), and the content outlet (242) formed at a center of the valve lower body (24), wherein the valve plate (40) is coupled between the valve upper body (22) and the valve lower body (24) of the valve main body (20), wherein the push button (50) is coupled to an upper portion of the valve upper body (22) and provided on a central portion thereof with the outlet (51) for discharging the contents therethrough, in which the content opening/closing piece (513) is formed at a lower inside of the outlet (51), wherein the deformable pressure member (60) is coupled to an inside of the push button (50), placed on the valve upper body (22), provided on a central portion thereof with the valve protrusion wheel (62), and having a coupling sill (64) protruding from an outer circumferential portion thereof, and wherein the elastic member (70) is constructed for pressing an outer circumferential surface end of the deformable pressure member (60) and elastically supporting the push button (50).

6. The foundation container of claim 1, wherein the discharge pump (600) includes:

a valve main body (20-2) having the content outlet (242) formed at a center thereof and a receiving sill (222) formed on an upper surface thereof, wherein the valve plate fixing member (30) is coupled to an inside of the valve main body (20-2), having a ring shape and provided on an inner circumferential portion of an upper surface thereof with a valve plate support sill (32);

wherein the valve plate (40) is coupled between the valve main body (20-2) and the valve plate fixing member (30, wherein the push button (50) is coupled to an upper portion of the valve upper body (22) and provided on a central portion with the outlet (51) for discharging the contents therethrough, in which the content opening/closing piece (513) is formed at a lower inside of the outlet (51), wherein the deformable pressure member (60) is coupled to an inside of the push button (50), placed on the valve main body (20-2), provided on a central portion thereof with the valve protrusion wheel (62), and having a coupling sill (64) protruding from an outer circumferential portion thereof and wherein the elastic member (70) is constructed for pressing an outer circumferential surface end of the deformable pressure member (60) and elastically supporting the push button (50).

7. The foundation container of claim 5, further comprising an extension protrusion wheel (67) integrally formed on an outer circumferential portion of the coupling sill (64).

8. The foundation container of claim 1, further comprising a sealing auxiliary ring (320) coupled to the inner container main body (300) to enhance sealing force.

9. The foundation container of claim 1, further comprising an auxiliary container (370) formed in the inner container main body (300).

10. The foundation container of claim 1, further comprising a fixing part (330) coupled to an upper portion of the inner container main body (300).

11. The foundation container of claim 1, wherein the content spreading member (700) is formed with a discharge hole (710) and includes a push button (50) and a spreading plate (750) formed on an upper portion of the push button (50).

12. The foundation container of claim 11, wherein the spreading plate (750) includes a spreading passage (751) having a wave shape.

13. The foundation container of claim 4, further comprising a sealing auxiliary ring (320) coupled to the inner container main body (300) to enhance sealing force.

14. The foundation container of claim 3, further comprising an auxiliary container (370) formed in the inner container main body (300).

15. The foundation container of claim 3, further comprising a fixing part (330) coupled to an upper portion of the inner container main body (300).

16. The foundation container of claim 4, wherein the content spreading member (700) is formed with a discharge hole (710) and includes a spreading plate (750) formed on an upper portion of the push button (50).

17. The foundation container of claim 16, wherein the spreading plate (750) includes a spreading passage (751) having a wave shape.

* * * * *